US006224436B1

(12) United States Patent
Westhoff et al.

(10) Patent No.: US 6,224,436 B1
(45) Date of Patent: May 1, 2001

(54) REVERSE GATE FOR WATER JET APPARATUS

(75) Inventors: Paul E. Westhoff, Kenosha; James R. Jones, Neosho, both of WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/472,715

(22) Filed: Dec. 24, 1999

(51) Int. Cl.[7] ..... B63H 11/11
(52) U.S. Cl. ..... 440/41
(58) Field of Search ..... 60/221, 222; 440/38, 440/40–42

(56) References Cited

U.S. PATENT DOCUMENTS 3,272,439 * 9/1966 Rosentrater ..... 440/41
5,551,898 * 9/1996 Matsumoto ..... 440/41
5,752,864 5/1998 Jones et al. ..... 440/41

* cited by examiner

*Primary Examiner*—Ed Swinehart
(74) *Attorney, Agent, or Firm*—Dennis M. Flaherty

(57) ABSTRACT

A water jet apparatus has a reverse gate which allows a boat or other marine craft to be steered in reverse in the same manner as an automobile. The reverse gate accomplishes this by reversing the flow exiting the steering nozzle. When the steering nozzle is positioned to the left, causing the rearward exit flow to be directed to the left side of a midplane of the water jet apparatus, the reverse gate redirects that leftward and rearward flow so that it flows rightward and forward. Conversely, when the steering nozzle is positioned to the right, causing the rearward exit flow to be directed to the right side of the midplane, the reverse gate redirects that rightward and rearward flow so that it flows leftward and forward.

28 Claims, 17 Drawing Sheets

| FIG.2A | FIG.2B |
|---|---|

REVERSE GATE FOR WATER JET APPARATUS

FIELD OF THE INVENTION

This invention generally relates to water jet apparatus for propelling boats and other watercraft. In particular, the invention relates to mechanisms for shifting a water jet apparatus to selectively propel a craft in the forward or reverse direction.

BACKGROUND OF THE INVENTION

It is known to propel a boat or other watercraft using a water jet apparatus mounted to the hull, with the powerhead being placed inside (inboard) the hull. The drive shaft of the water jet apparatus is coupled to the output shaft of the inboard motor. The impeller is mounted on the drive shaft and housed in a water jet housing, the interior surface of which defines a water tunnel. The impeller is designed such that during motor operation, the rotating impeller impels water rearward through the water tunnel. The thrust propels the boat forward.

In addition, it is known to provide a mechanism for diverting the exiting water flow to one side or the other of a water jet midplane, thereby enabling the boat operator to steer the boat to the left or right during forward propulsion. One such mechanism is a steering nozzle pivotably mounted to the water jet housing and in flow communication with the housing outlet. Preferably the pivot axis of the steering nozzle lies in the water jet midplane. As the steering nozzle is pivoted to the left of a central position, the water flow out of the housing is diverted leftward, producing a thrust which pushes the water jet apparatus and the boat stern to the right, thereby causing the bow of the boat to turn to the left, similarly, the boat bow turns to the right when the steering nozzle is pivoted to the right of the central position.

It is also known to provide a mechanism for reversing the direction of the water flow exiting the steering nozzle. The reverse gate can be pivotably mounted to the steering nozzle, its pivot axis being generally perpendicular to the pivot axis of the steering nozzle. In the up position, the reverse gate is clear of the water flow exiting the steering nozzle. In the down position, the reverse gate is disposed in the path of the exiting water flow. In its simplest embodiment, the reverse gate has a U-shaped channel which reverses the water flow exiting the steering nozzle. In other words, when the steering nozzle is turned to the left, the resulting water flow having rearward and leftward flow components is redirected by the reverse gate to have forward and rightward components. This produces a thrust which pulls the boat rearward and propels the water jet apparatus and boat stern to the left, causing the boat to turn left during rearward movement. Similarly, the boat turns to the right during rearward movement when the steering nozzle is turned to the right. The provision of a steerable reverse gate allows the boat operator to steer in forward and reverse in the same manner that an automobile can be steered.

In accordance with another known design, the reverse gate is not steerable, i.e., the reverse gate is pivotably mounted to the water jet housing. In the up position, the reverse gate is clear of the water flow exiting the steering nozzle; in the down position, the reverse gate obstructs the water flow exiting the steering nozzle and reverses the rearward flow component, but does not reverse the lateral flow component. As a result, when the steering nozzle is turned to the left, the resulting water flow having rearward and leftward flow components is redirected by the reverse gate to have forward and leftward components. This produces a thrust which pulls the boat rearward and propels the water jet apparatus and boat stern to the right, causing the boat to turn to right during rearward movement. Similarly, the boat turns to the left during rearward movement when the steering nozzle is turned to the right. Thus there is a need for a non-steerable reverse gate design which would cause the rearward-moving boat to turn left when the steering nozzle is turned to the left and to turn right when the steering nozzle is turned to the right.

SUMMARY OF THE INVENTION

The present invention is a water jet apparatus comprising a non-steerable reverse gate which redirects the steered pump discharge to the opposite side of the boat. In effect, to steer to the port side in reverse, the thrust is discharged to starboard (and vice versa). The additional desired effect is to discharge the reverse steering thrust as close to 90 degrees relative to the water jet longitudinal centerline as possible. The reason for this characteristic is that the boat is steered most efficiently with a 90-degree vector. This allows a boat or other marine craft to be steered in reverse in the same manner as an automobile.

The reverse gate in accordance with the preferred embodiments accomplishes the foregoing by reversing the flow exiting the steering nozzle. When the steering nozzle is positioned to the left, causing the rearward exit flow to be directed to the left side of a midplane of the water jet apparatus, the reverse gate redirects that leftward and rearward flow so that it flows predominantly rightward and forward. Conversely, when the steering nozzle is positioned to the right, causing the rearward exit flow to be directed to the right side of the midplane, the reverse gate redirects that rightward and rearward flow so that it flows predominantly leftward and forward.

In accordance with the preferred embodiments of the invention, the water jet apparatus comprises a housing having a water tunnel, a steering nozzle pivotably mounted to the housing and in flow communication with the outlet of the housing outlet, and a reverse gate pivotably mounted to the housing. The reverse gate is pivotable between forward and reverse positions. In the forward position, the reverse gate is clear of the flow exiting the steering nozzle. With the reverse gate in the forward position and the steering nozzle in a central position, i.e., symmetrically disposed relative to a midplane of the water jet housing, the exit flow is rearward during water jet operation and the boat is propelled forward. In the reverse position, the reverse gate obstructs the flow exiting the steering nozzle and changes the rearward directional flow component into a predominantly forward directional flow component, which forward flow propels the boat rearward. If the steering nozzle is in the central position, then the boat is propelled along a straight line. If the steering nozzle is in an off-center position, then the boat is propelled along an arcuate path, i.e., the boat will turn. When the boat is being propelled forward, turning the steering nozzle to the right of the midplane causes the boat to turn right; turning the steering nozzle to the left of the midplane causes the boat to turn left.

The reverse gate of the invention deflects the flow exiting the steering nozzle to achieve the desired steering response when the boat is moving in reverse. In particular, when the steering nozzle is pivoted to the left side of the midplane during reverse operation, so that the water flow exiting the steering nozzle has predominantly leftward and rearward flow components, the reverse gate is designed to redirect that water flow so that it has predominantly rightward and forward flow components. Conversely, when the steering nozzle is pivoted to the right side of the midplane, so that the water exiting the steering nozzle has predominantly rightward and rearward flow components, the reverse gate redirects that water flow so that it has predominantly leftward and forward flow components. Thus when the boat operator shifts the boat into reverse and turns the steering wheel to the right, the stern of the boat will turn right as the boat backs up. Similarly, when the boat operator shifts the boat into reverse and turns the steering wheel to the left, the stern of the boat will turn left as the boat backs up.

In accordance with one preferred embodiment of the invention, a water jet apparatus comprises a housing comprising a water tunnel having an inlet and an outlet; and a reverse gate pivotably mounted to said housing, said reverse gate being pivotable between first and second shift positions. In the first shift position the reverse gate is removed from the path of water which has flowed out of the housing outlet and in the second shift position the reverse gate is disposed in the path of the water coming out of the housing outlet. The reverse gate comprises first and second arms pivotably mounted to the housing, and a deflecting shield supported by the first and second arms. The deflecting shield comprises a reversing channel designed to guide water flow having a rearward flow component to predominantly flow with a forward flow component, a first turning channel designed to guide water flow having a leftward flow component to predominantly flow with a rightward flow component, and a second turning channel for guiding water flow having a rightward flow component to predominantly flow with a leftward flow component.

Figures 1, 1A:
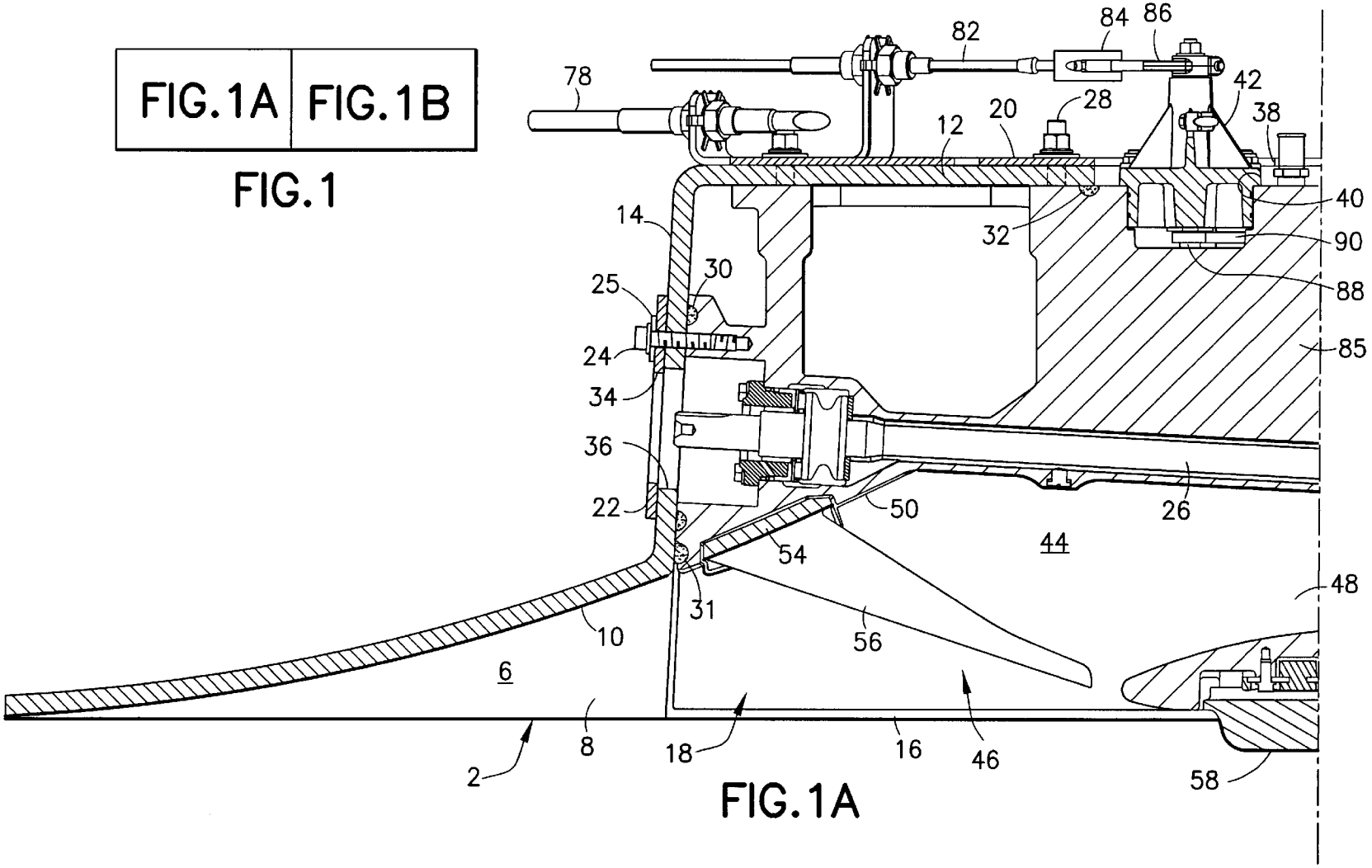
FIG. 1 is a schematic (presented in two sheets respectively labeled FIGS. 1A and 1B) showing a sectional view of a water jet apparatus mounted to a boat hull in accordance with a preferred embodiment of the invention, the section being taken along a vertical midplane.
Figure 1B:
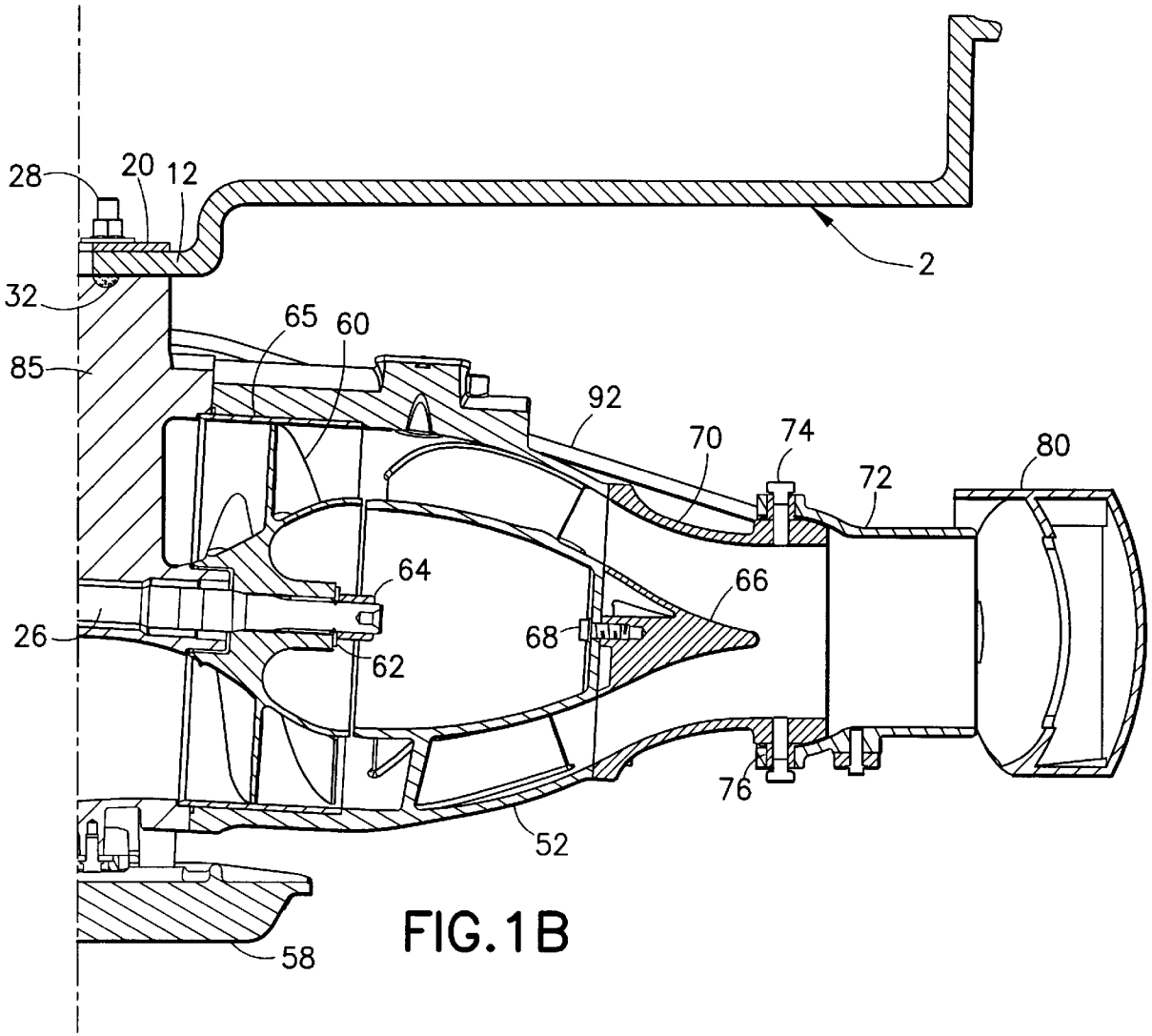

FI 2 is a schematic (presented in two sheets respectively labeled FIGS. 2A and 2B) showing a top view of the top mounting plate and the water jet apparatus depicted in FIG. 1, with the hull removed.

Figure 3:
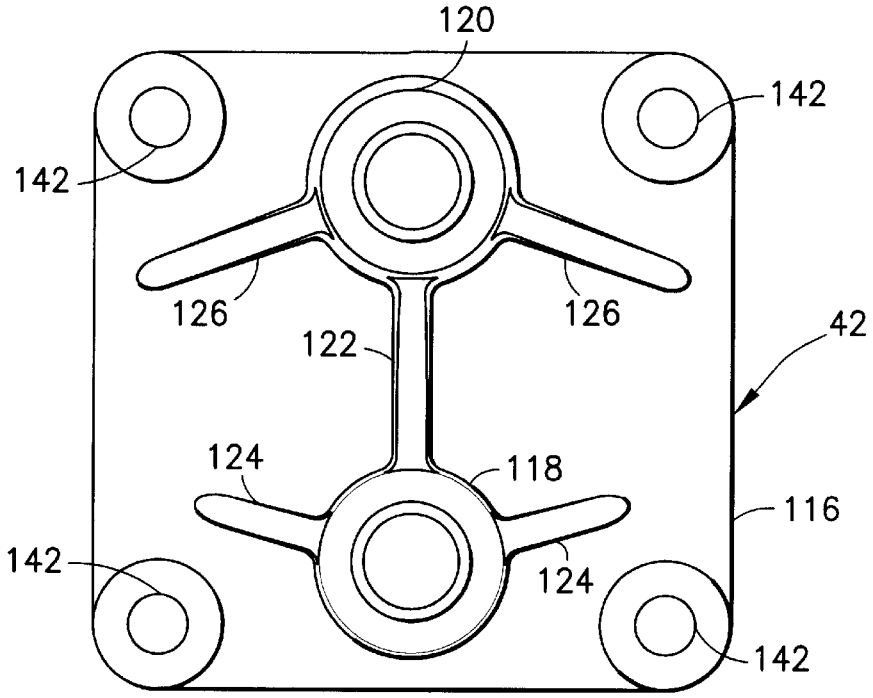
Figure 4:
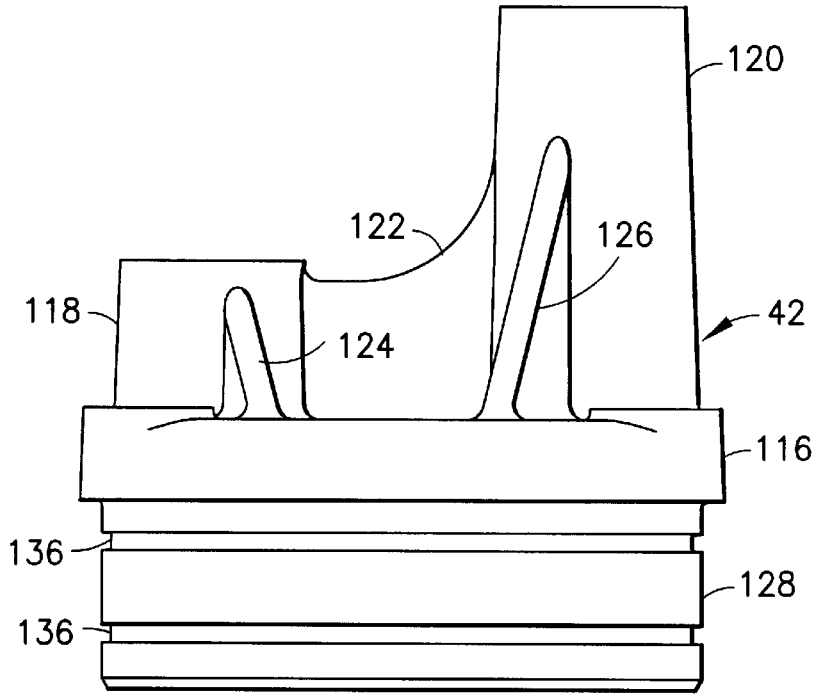
Figure 6:
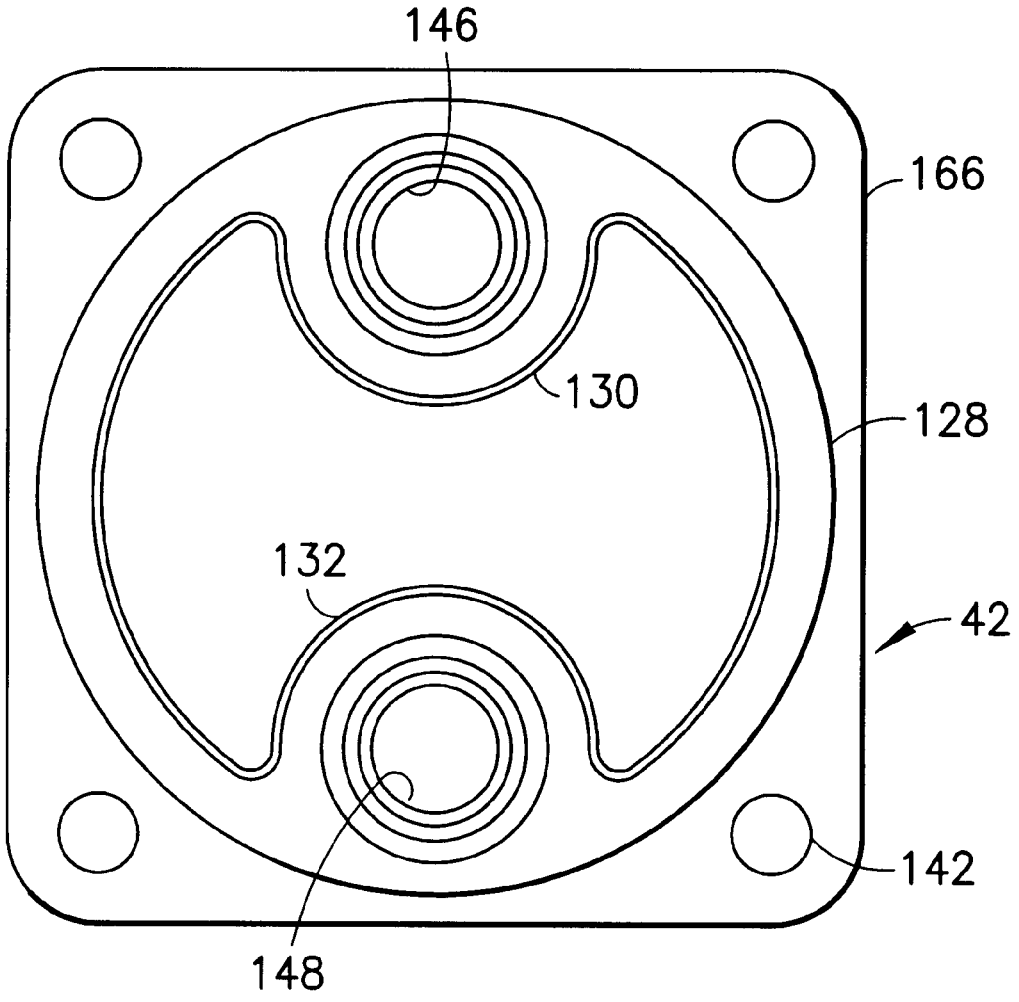

FIGS. 3, 4 and 6 are schematics showing top, side and bottom views of the shift and steering control housing in accordance with the preferred embodiment of the invention.

Figures 2, 2A:
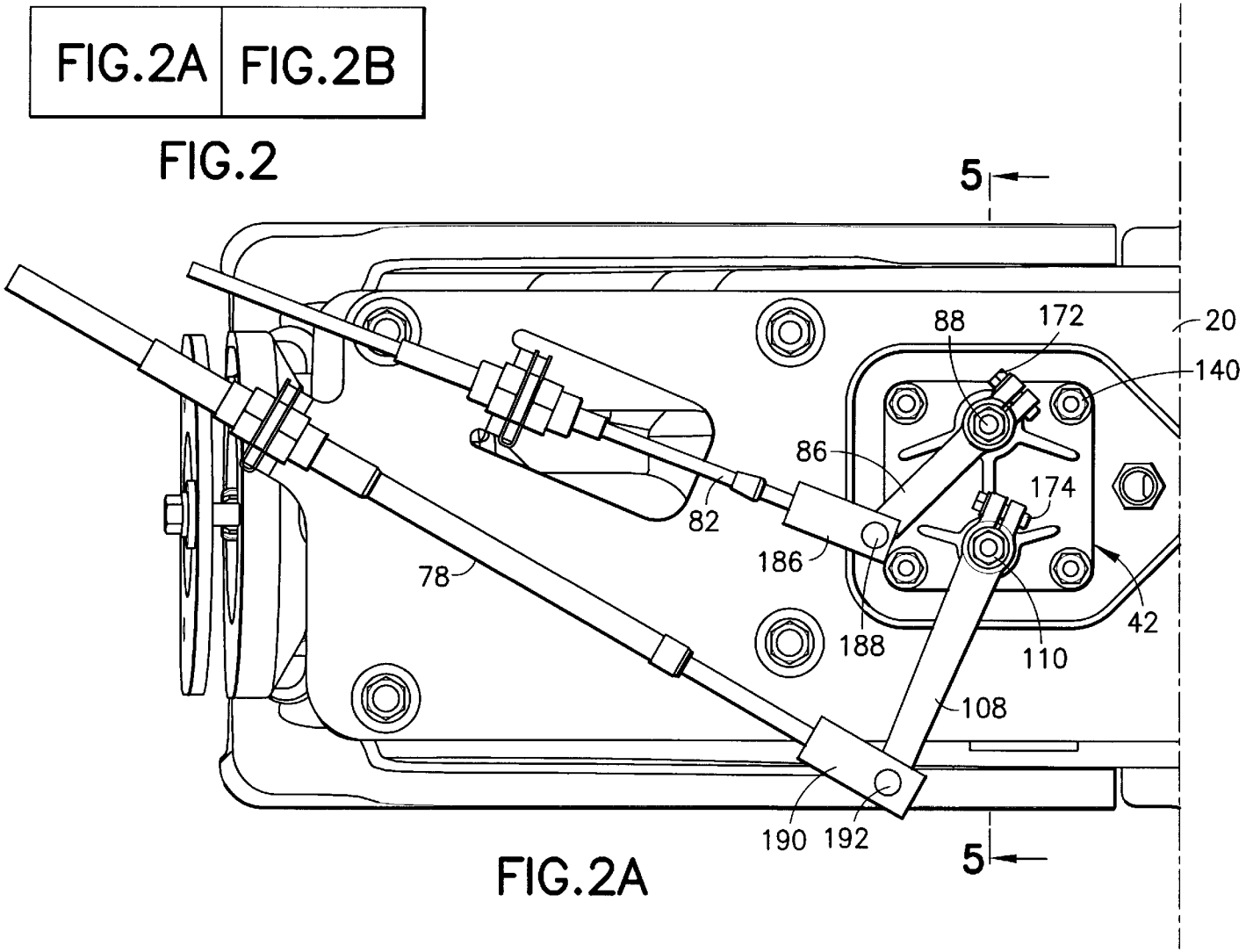
Figure 5:
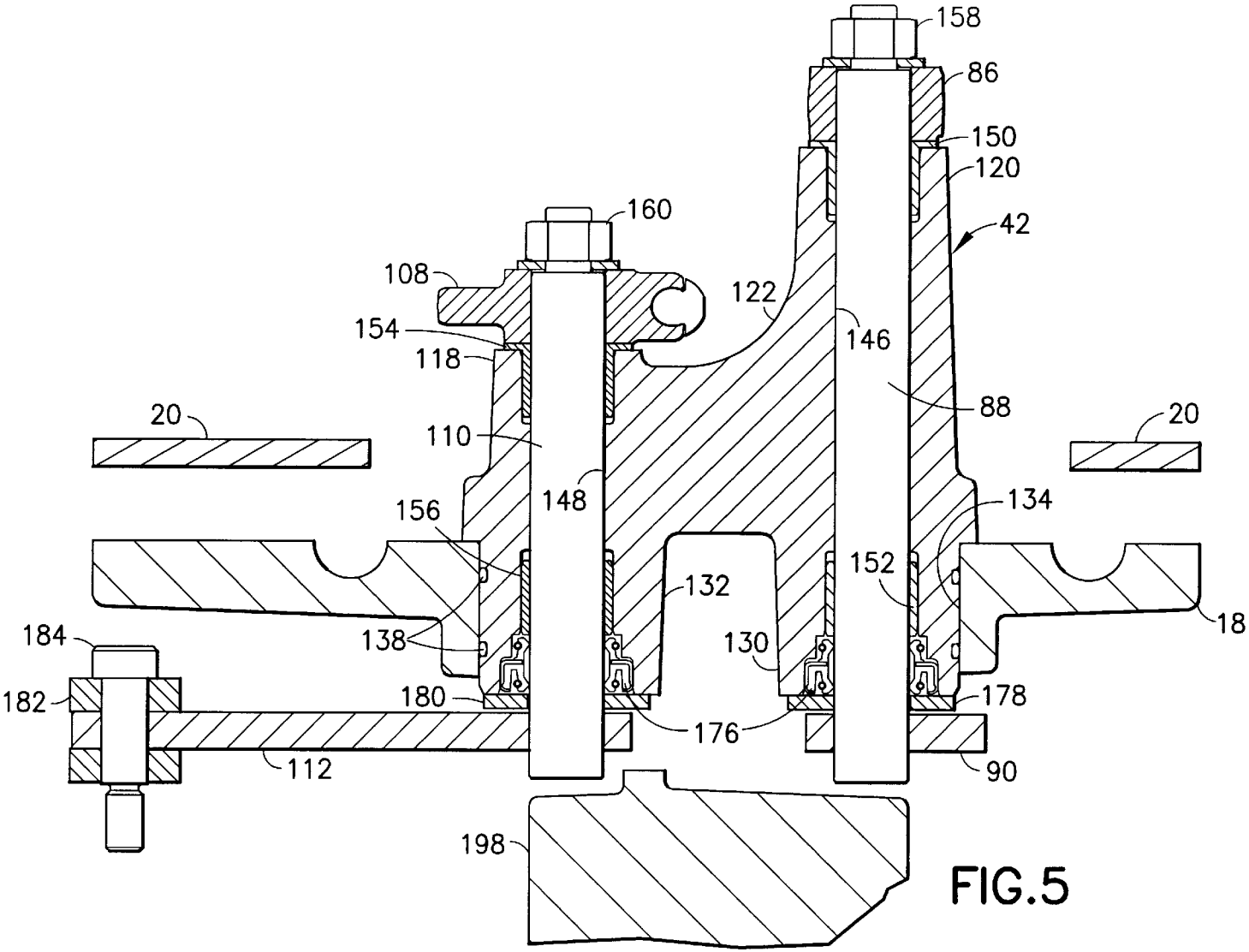

FIG. 5 is a schematic showing a sectional view taken along line 5—5 shown in FIG. 2A.

Figure 7:
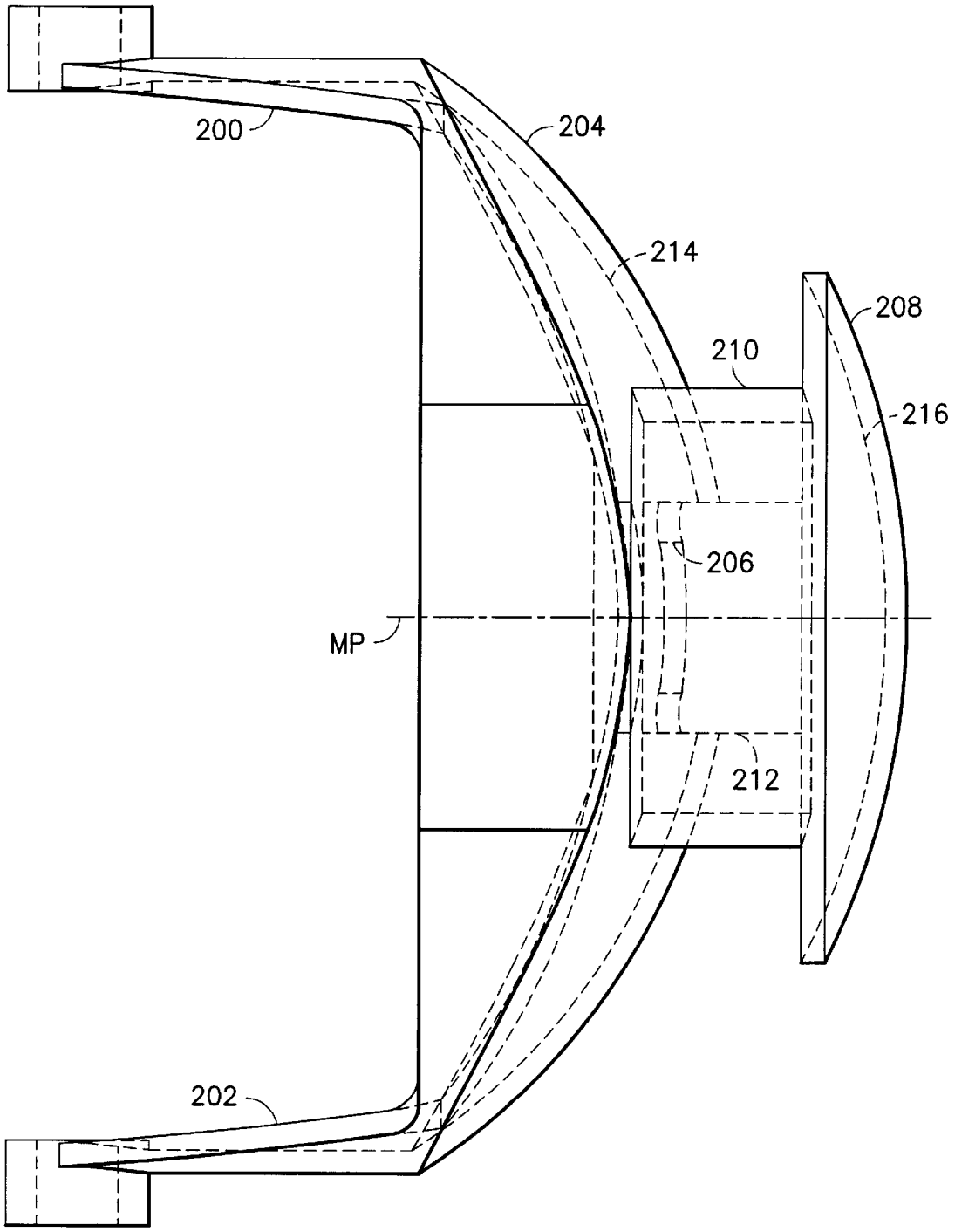
Figure 8:
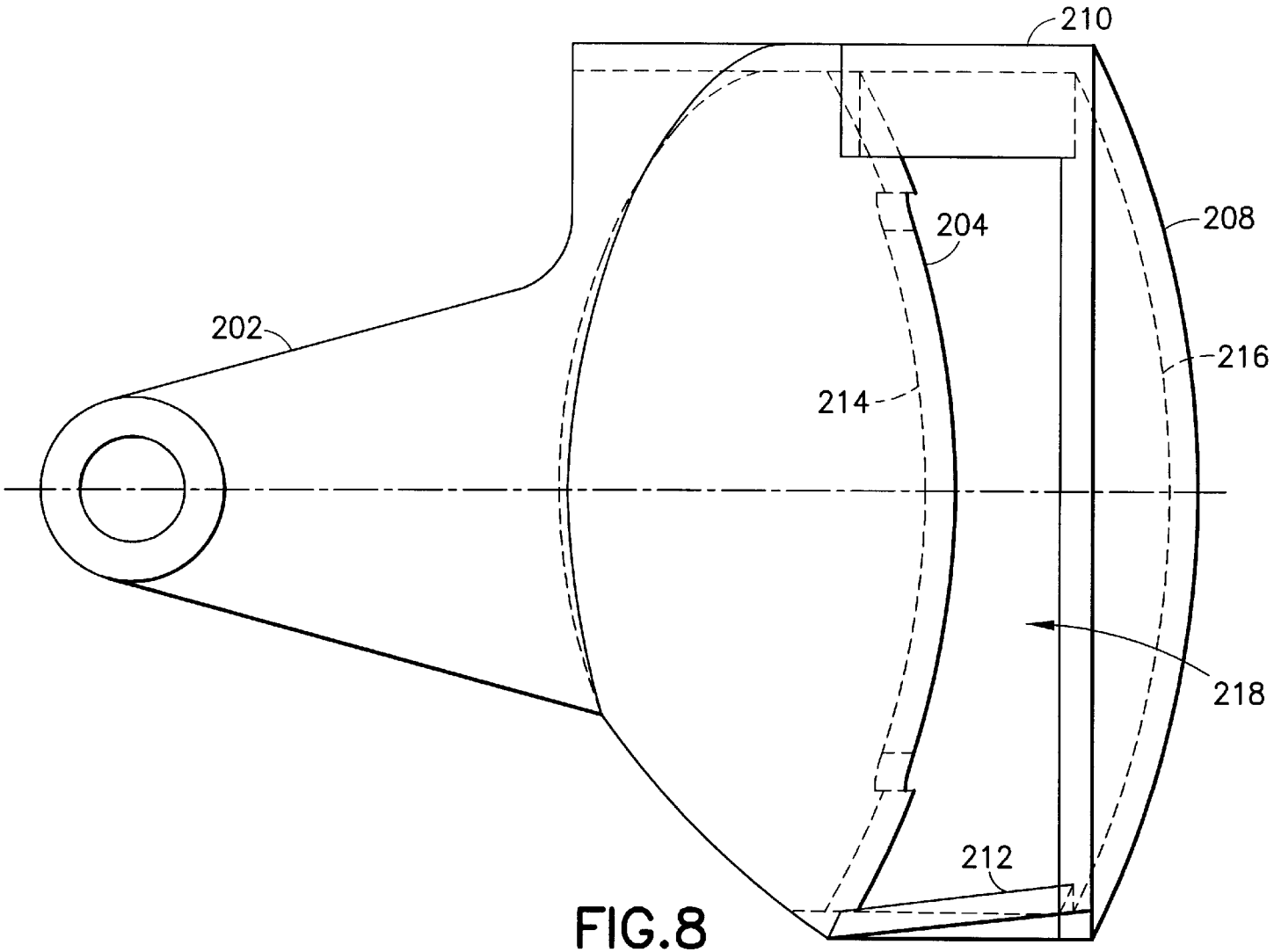
Figure 9:
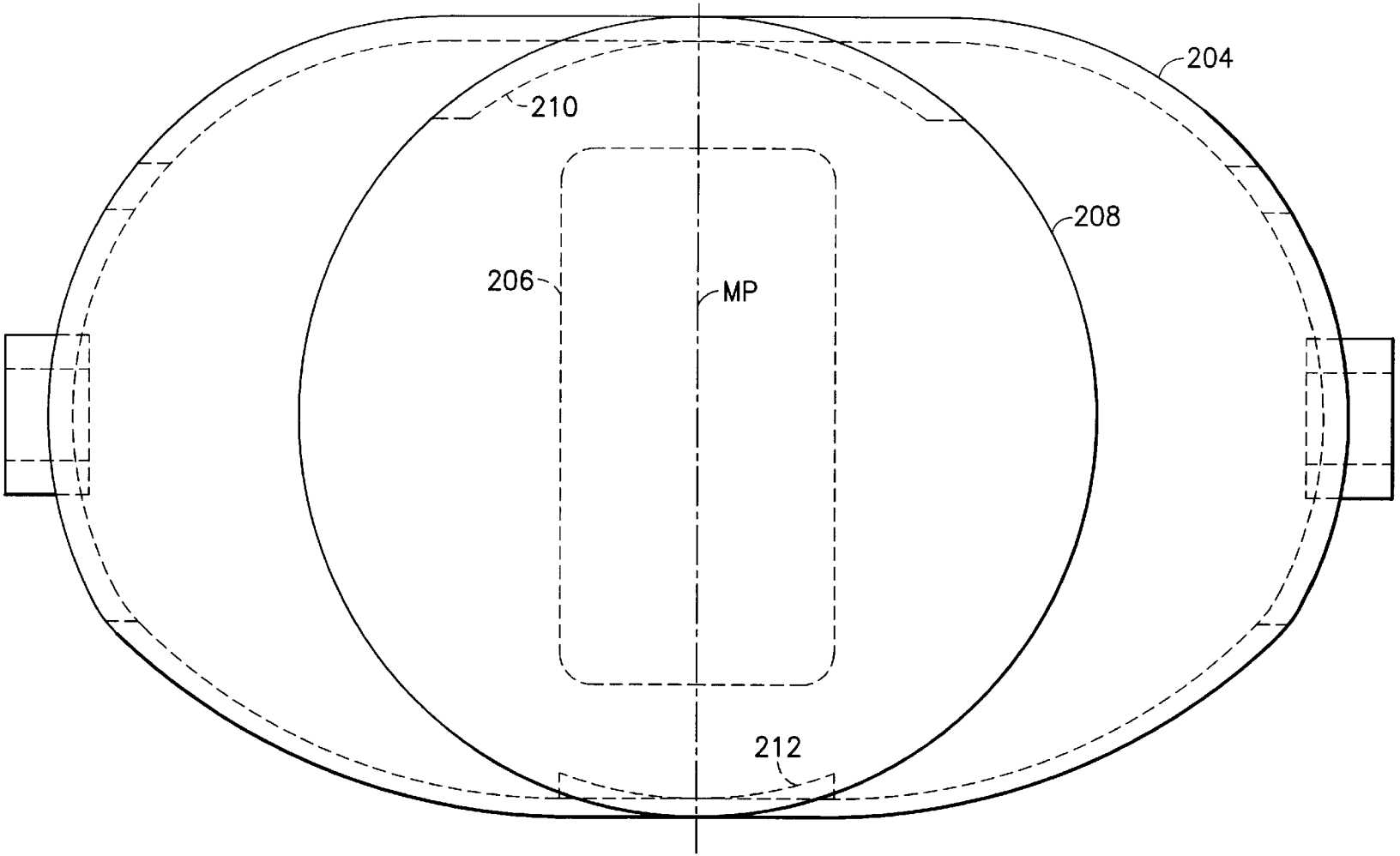

FIGS. 7–9 are schematics showing top, side and rear views, respectively, of a reverse gate in accordance with one another preferred embodiment of the invention.

FIGS. 10–13 are schematics showing top, side, rear and front views, respectively, of a reverse gate in accordance with another preferred embodiment of the invention.

Figure 14:
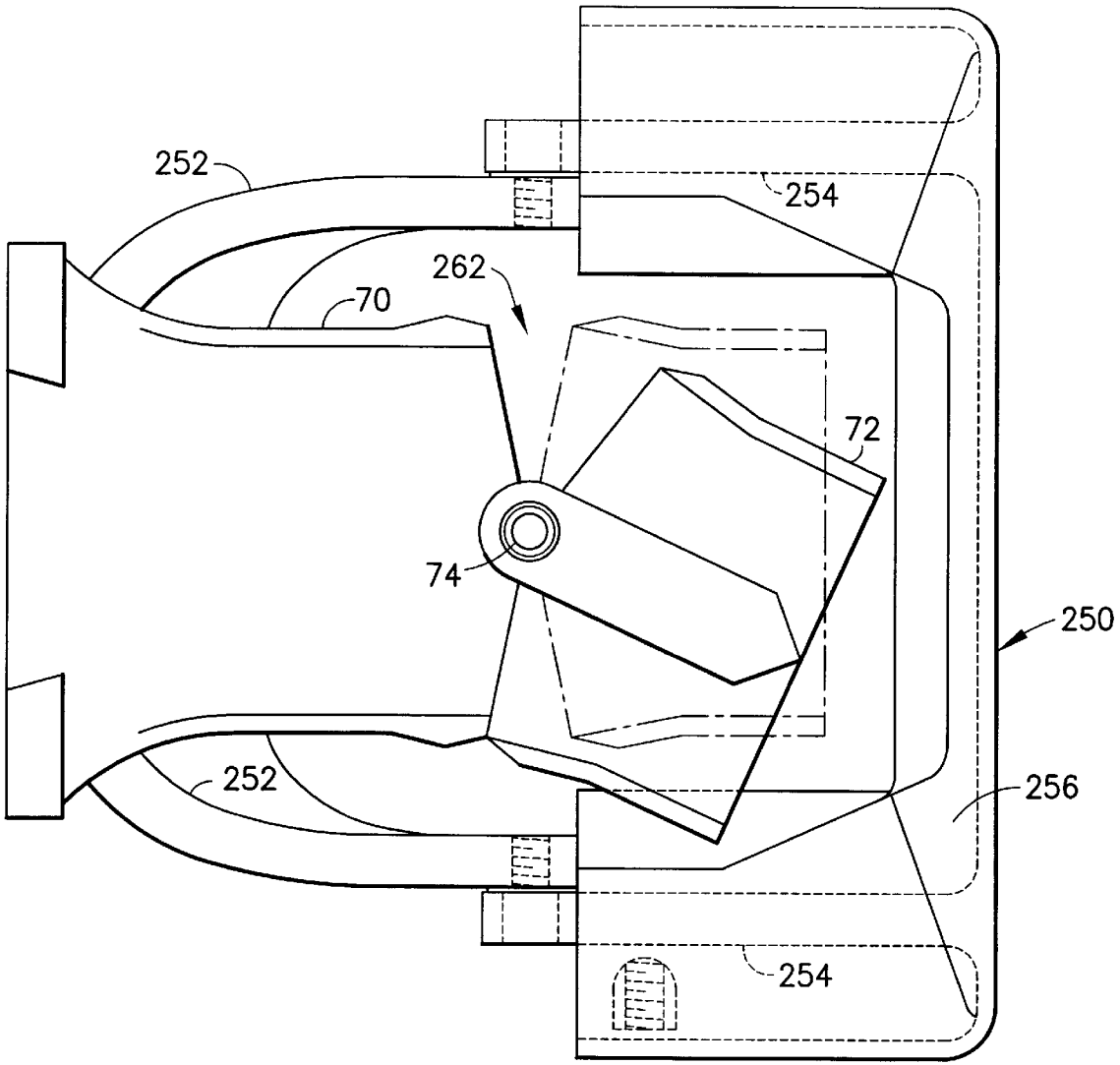
Figure 15:
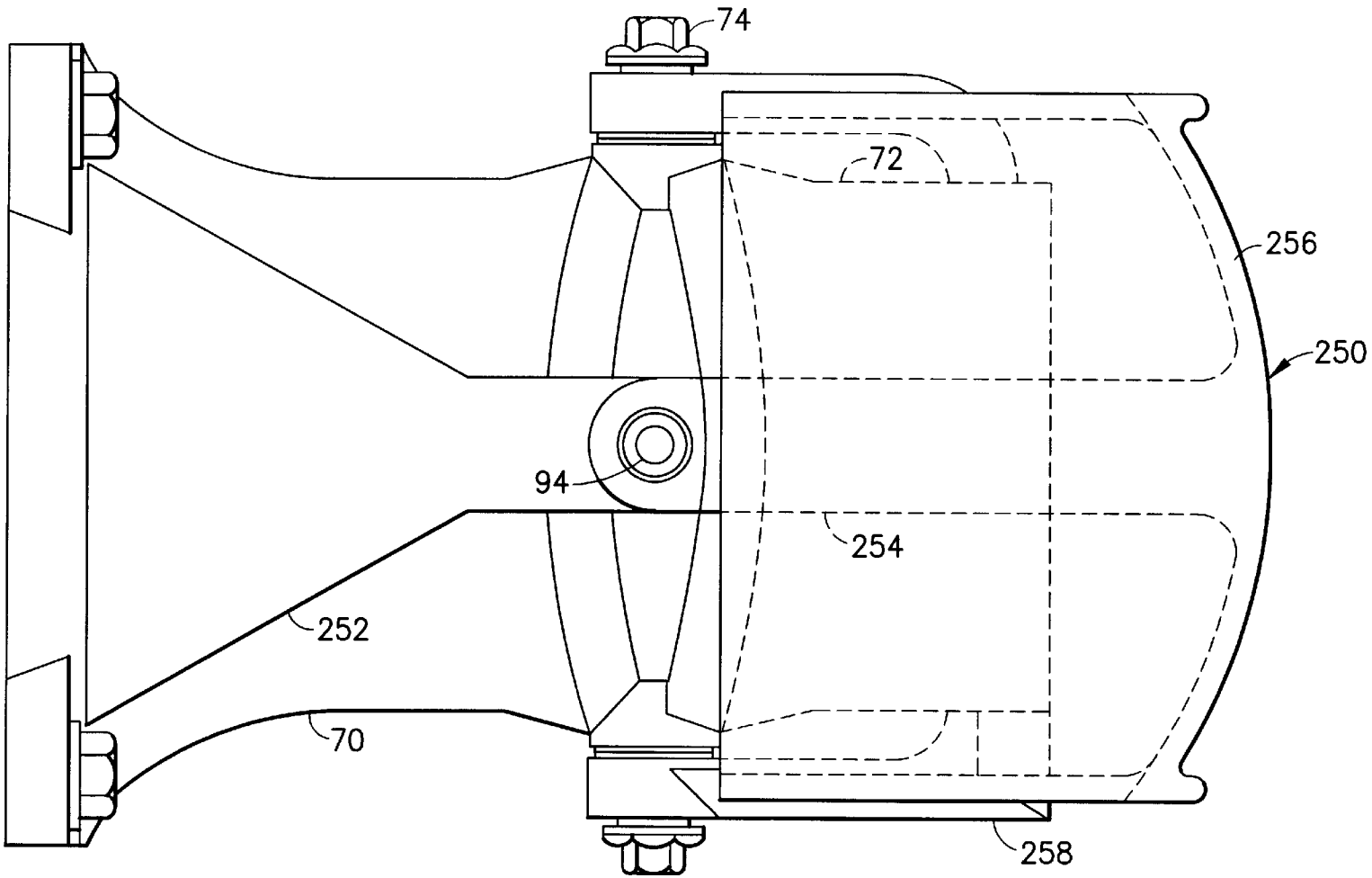
Figure 16:
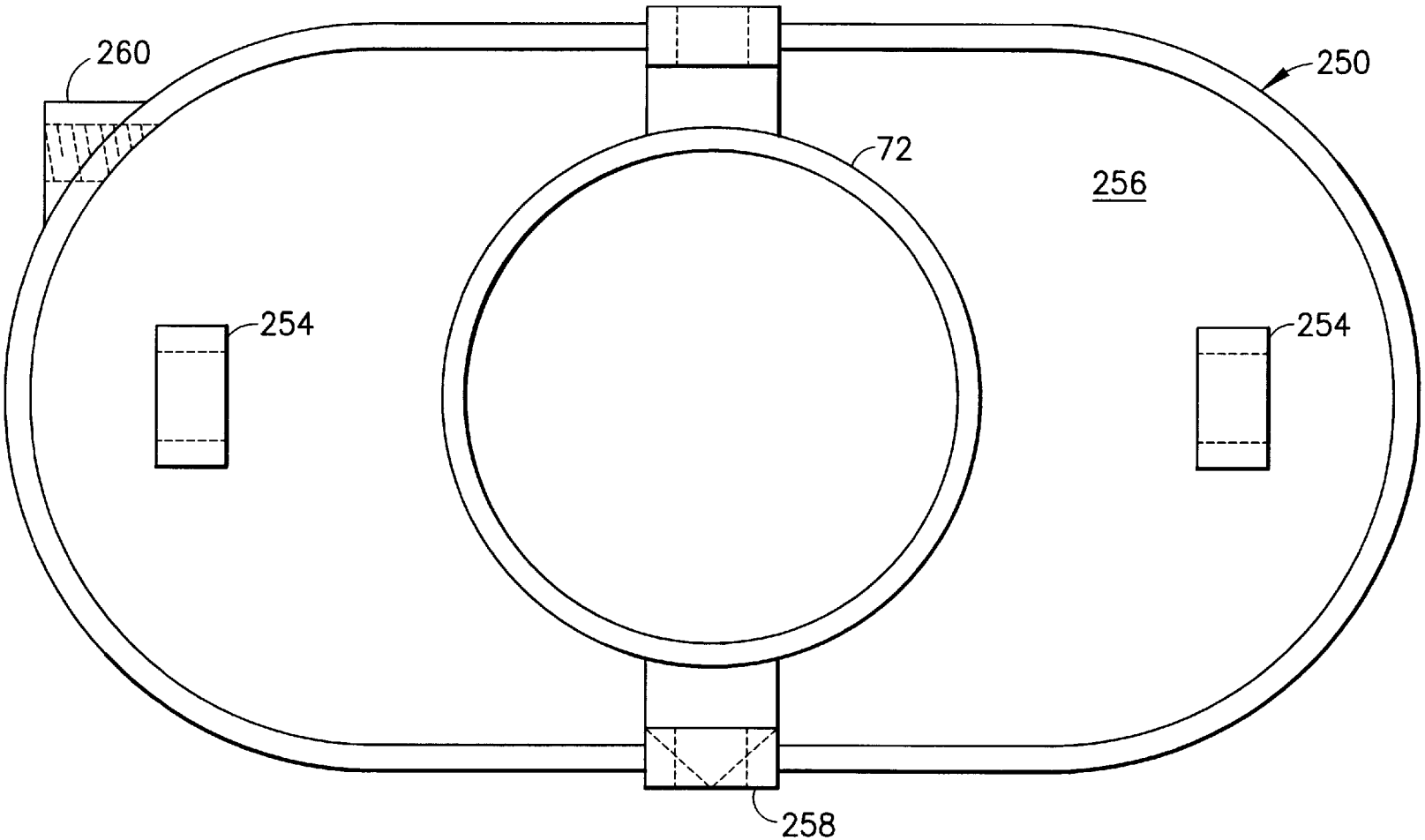

FIGS. 14–16 are schematics showing bottom, side, and front views, respectively, of a reverse gate in accordance with yet another preferred embodiment of the invention.

DETAILED DESCRIPTION OF THE PREFERRED EMBODIMENTS

FIG. 1 depicts a water jet apparatus which may incorporate a reverse gate in accordance with any of the preferred embodiments disclosed herein. The apparatus depicted in FIG. 1 is merely one example of such apparatus. The reverse gate of the invention can be utilized in water jet apparatus different in structure than that shown in FIG. 1.

The water jet apparatus shown in FIG. 1 is designed to be installed in a cavity under a section of the hull and in flow communication with the outlet of a inlet ramp built into the hull. As seen in FIG. 1, the boat hull 2 has a inlet ramp 6 formed by a pair of opposing sidewalls 8 (only one of which is visible in FIG. 1) and a guide surface 10 which curves gently upward in the aft direction. The end of the inlet ramp 6 communicates with a cavity in which the water jet apparatus is installed. This cavity for the water jet apparatus is defined by a horizontal hull section 12, a vertical hull section 14 and a pair of opposing sidewalls 16 (only one of which is visible in FIG. 1), the cavity being open at the bottom and rear to allow insertion of the water jet apparatus.

The water jet apparatus comprises an inlet housing 18 which is slid into the aforementioned cavity and bolted to the hull by means of a top mounting plate 20 and a front plate 22. At the time of inlet housing installation, the drive shaft 26 is already rotatably mounted in the inlet housing. In particular, the inlet housing 18 comprises a vertical strut 85 having an axial bore which houses a portion of the drive shaft.

During inlet housing installation, the front plate 22 is placed on the inside of the vertical hull section 14 and the inlet housing 18 is placed on the outside of vertical hull section 14. Screws 24 (only one of which is visible in FIG. 1) hold the front plate, vertical hull section and inlet housing together. The numeral 25 in FIG. 1 denotes a washer. The front plate 22 has an opening 34 (best seen in FIG. 2) which, in the assembled state, is aligned with an opening 36 in the vertical hull section 14 to allow the output shaft (not shown) from the inboard motor to be coupled to the front end of the drive shaft 26. The studs 28 are affixed to the inlet housing 18. The inlet housing 18 is inserted into the hull cavity and the studs 28 are inserted into throughholes in the hull. The front plate 22 is then positioned and screws 24 are screwed into the inlet housing 18. The top mounting plate 20 is then placed over the studs 28 and secured to the hull using nuts and washers.

In the assembled position, a front portion of the inlet housing 18 is sealed against the vertical hull section 14 by means of a seal 30 and a top portion of the inlet housing 18 is sealed against the horizontal hull section 12 by means of a seal 32. The seal 30 encompasses the interface where the openings in the vertical hull section 14 and inlet housing for the drive shaft 26 meet and is designed to prevent water leaking into the drive shaft assembly or into the boat via the opening 36. Similarly, the top mounting plate 20 has an opening 38 which, in the assembled state, is aligned with an opening 40 in the horizontal hull section 12 to allow a shift and steering control housing 42 to be placed in a corresponding opening in the top wall of the inlet housing 18. The seal 32 encompasses the interface where the openings in the horizontal hull section 12 and inlet housing for the shift and steering housing 42 meet and is designed to prevent water leaking into the boat via the opening 38. In addition, a seal 31 is pressed between the inlet housing 18 and the hull along the front and sides of the inlet housing.

The inlet housing 18 has a water tunnel 44 with an inlet 46. The water tunnel 44 has a pair of sidewalls 48 (only one of which is shown in FIG. 1) which are generally coplanar with the sidewalls 8 of the hull inlet ramp 6. In addition, the water tunnel 44 has a guide surface 50 which starts at a point near where the guide surface 10 of the hull inlet ramp 6 ends and then curves gradually upward in the aft direction. As a result of the foregoing structure, there is a generally smooth transition between the end of inlet ramp 6 and the beginning of water tunnel 44. Thus the hull 2 and the inlet housing 18 combine to form a single inlet for guiding water toward the inlet of a stator housing 52 located downstream of the inlet housing.

An inlet grate 54 extends across the inlet 46 of the water tunnel 44 and serves to block the admission of debris into the water jet apparatus. The inlet grate 54 comprises a multiplicity of generally parallel tines 56 which extend downward and rearward from an upper end of the inlet grate. Only the upper end of the inlet grate is attached to the inlet housing. The cantilevered design is based on the theory that any weeds that wrap around the grate will be drawn down to the lower, open end and slide off under the boat and/or be drawn into the pump and chopped up. In addition, a ride plate 58 is attached to the bottom of the inlet housing 18.

As shown in FIG. 1, the drive shaft projects in the aft direction out of the inlet housing 18. The impeller is pre-assembled in the unit prior to mounting in the hull. The hub and blades of impeller 60 are integrally formed as one cast piece. The hub of impeller 60 has a splined bore which meshes with splines formed on the external surface of the drive shaft 26, so that the impeller 60 will rotate in unison with the driveshaft. The impeller 60 is held securely on the drive shaft 26 by a nut washer 62, which in turn is held in place by a lock nut 64 tightened onto a threaded end of the drive shaft 26. As seen in FIG. 1, the hub of the impeller 60 increases in radius in the aft direction, transitioning gradually from a generally conical outer surface at the leading edge of the impeller hub to a generally circular cylindrical outer surface at the trailing edge of the impeller hub. This outer surface of the impeller hub forms the radially inner boundary for guiding the flow of water impelled by the impeller.

The stator housing 52 comprises inner and outer shells connected by a plurality of stator vanes, all integrally formed as a single cast piece. The hub of the stator housing 52 gradually decreases in radius in the aft direction, starting out at a radius slightly less than the radius at the trailing edge of the impeller hub. The stator vanes are designed to redirect the swirling flow out of the impeller 60 into non-swirling flow. The stator housing hub has a radial end face with a central throughhole. Before the stator housing is installed, a tail cone cover 66 is attached to the radial end face of the stator housing hub by a screw 68. The front of the stator housing 52 is then attached to the rear of the inlet housing 18 by a plurality of screws (not shown in FIG. 1).

A circumferential recess in the stator housing 52 at a position opposing the impeller blade tips has a circular cylindrical wear ring 65 seated therein. Wear to the impeller blade tips is mainly due to the pumping of abrasives such as beach sand. The purpose of the wear ring 65 is to protect the soft aluminum casting with a hard stainless steel surface, thus drastically reducing the rate of wear.

After the stator housing 52 (with attached tail cone cover 66) has been attached to the inlet housing 18, the front of an exit nozzle 70 is attached to the rear of the stator housing 52 by screws. The front faces of the tail cone cover 66 and the exit nozzle 70 are preferably coplanar. The water flowing out of the stator housing 52 will flow through the space between the tail cone cover 66 and the exit nozzle 70, and then will exit the exit nozzle at its outlet.

Figure 2B:
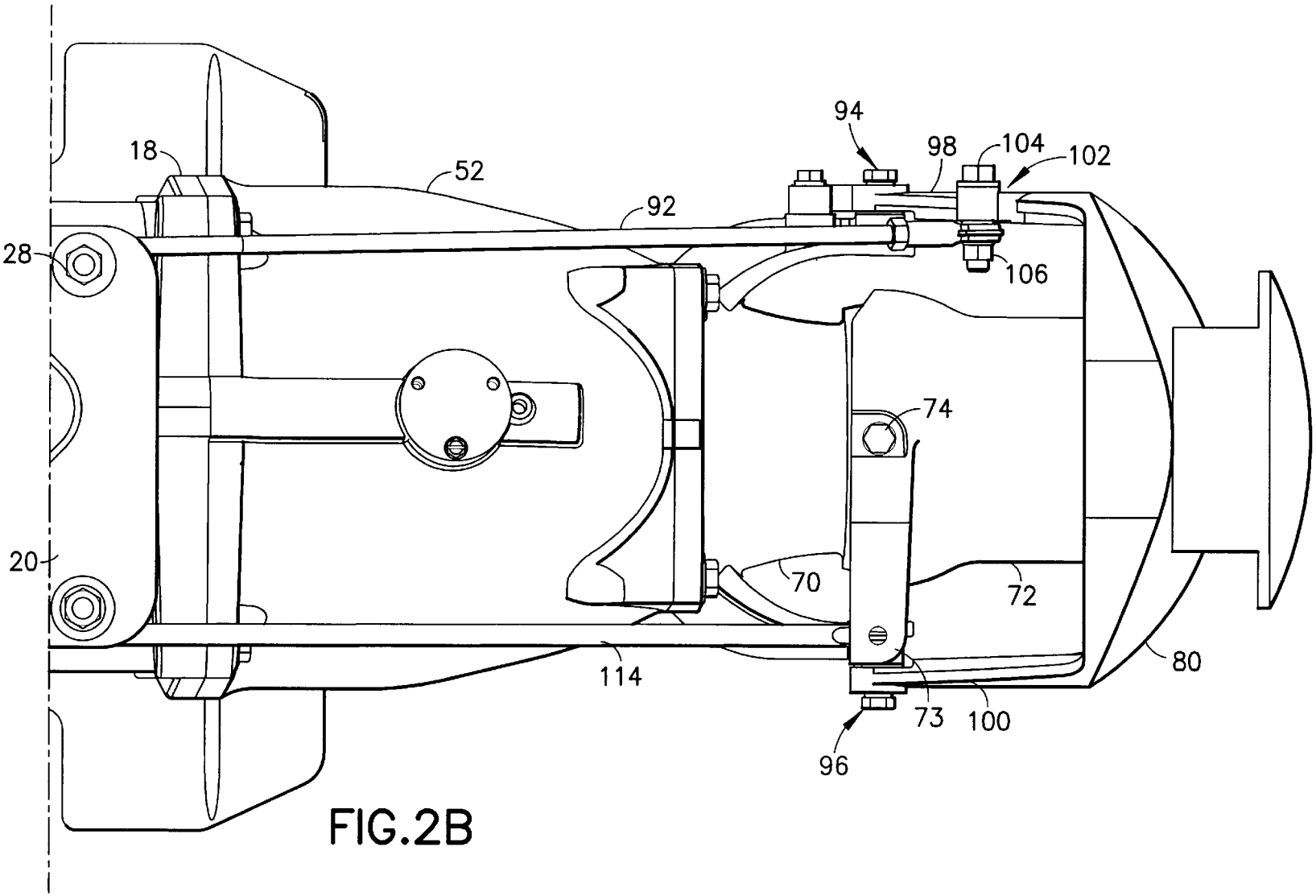

The water jet apparatus shown in FIG. 1 is provided with a steering nozzle 72 which can change the direction of the water exiting the exit nozzle 70. The steering nozzle 72 is pivotably mounted to the exit nozzle 70 by a pair of pivot assemblies located at the top and bottom of the exit nozzle. Each pivot assembly comprises a screw 74, a sleeve (not visible in FIG. 1) and a bushing 76. The axes of the screws 74 are collinear and form a vertical pivot axis about which the steering nozzle 72 can rotate. In particular, the steering nozzle has a pair of circular holes in which the bushings 76 are seated. The sleeves are inserted inside the respective bushings 76. The screws 74 are in turn inserted in the sleeves and screwed into respective threaded holes in the exit nozzle 70. As best seen in FIG. 2B, the steering nozzle 72 has an arm 73 which is pivotably coupled to a flattened end of a steering rod 114. Displacement of the steering rod 114 in response to operation of a steering cable assembly 78 (see FIG. 2A) causes the steering nozzle to swing a desired direction about its vertical pivot axis.

In accordance with the preferred embodiments of the invention, the water jet apparatus is provided with a non-steerable reverse gate 80. In the forward position, the reverse gate 80 is raised, thereby allowing water to exit the steering nozzle 72 freely. In the reverse position, the reverse gate 80 is lowered to a position directly opposite to the outlet of the steering nozzle 72. The reverse gate is designed to partially reverse the flow of water exiting the steering nozzle 72 when the reverse gate is in the reverse position. This reverse flow of water will urge the boat in the rearward direction. To accomplish the foregoing, the reverse gate 80 is pivotably mounted to the exit nozzle 70 by a pair of pivot assemblies 94 and 96 located on opposite sides of the exit nozzle (see FIG. 2B). Each pivot assembly 94 and 96 has a construction substantially identical to the pivot assemblies previously described with reference to pivoting of the steering nozzle 72. As seen in FIG. 2B, the reverse gate has a pair of arms 98 and 100, the ends of which are pivotably coupled to the respective pivot assemblies 94, 96. The reverse gate 80 is pivoted by a shift rod 92, the end of which is coupled to arm 98 of the reverse gate 80 by means of a rod end assembly 102 which comprises a ball socket for allowing horizontal radial motion at the shift lever and vertical radial motion at the reverse gate. The rod end assembly is attached to arm 98 by means of a screw 104 and a lock nut 106. Displacement of the shift rod 92 in response to operation of a shift cable assembly 82 (see FIG. 2A) causes the reverse gate to swing in a desired direction, namely, into forward position or reverse position, with a "neutral" position therebetween. The reverse gate is designed to allow the boat to steer in reverse in the same direction like an outboard, stern drive or automobile.

In the apparatus depicted in FIGS. 1 and 2, the shift and steering cable assemblies (located inside the hull) are respectively coupled to shift and steering rods (located outside the hull) by means of respective lever and shaft assemblies rotatably supported in a shift and steering control housing 42 which penetrates the hull. The shift and steering control housing 42 is installed in a corresponding opening in the top of the inlet housing 18. As best seen in FIGS. 4 and 5, the housing 42 preferably comprises a base plate 116, an upper vertical tubular structure 118 integrally formed with base plate 116 and extending above it to a first height, and an upper vertical tubular structure 120 integrally formed with base plate 116 and extending above it to a second height greater than the first height. As seen in FIG. 5, the tubular structures 118 and 120 are reinforced by a rib 122 extending therebetween and integrally formed therewith and with the base plate 116. Additional reinforcement is provided by respective pairs of ribs 124 and 126 (see FIG. 3). As seen in FIG. 3, the base of housing 42 has a generally square shape with rounded corners. Below the base plate, the housing has a circular cylindrical lower wall 128 (shown in FIG. 6), integrally formed with lower vertical tubular structures 130 and 132. The lower wall 128 slides into a circular opening formed in the top wall of the inlet housing 18. The opening in the inlet housing communicates with the exterior of the water jet apparatus via a pair of opposing side channels through which the lower shift and steering levers (described below) respectively pass. The lower wall 128 is provided with a pair of annular grooves 136 (see FIG. 4) in which respective O-rings 138 (see FIG. 5) are installed to seal the interface of the respective housings 18 and 42 against leakage of water through opening 134 and into the hull.

Preferably the opening 40 (see FIG. 1A) in the horizontal hull section 12 closely matches the opening in mounting plate. As seen in FIG. 2A, the housing 42 is bolted to the inlet housing 18 by four studs 140. The shift and steering control housing 42 has four throughholes 142 at respective corners (see FIGS. 3 and 6). The studs 140 are threaded into respective threaded holes formed in the top wall of the inlet housing 18.

As seen in FIG. 5, the shift and steering control housing 42 has one bore 146 for receiving the shift shaft 88 and another bore 148 for receiving the steering shaft 110. The bore 146 has upper and lower annular recesses in which upper and lower bushings 150 and 152 are respectively inserted; the bore 148 has upper and lower annular recesses in which upper and lower bushings 154 and 156 are respectively inserted. The shift shaft 88 is rotatably supported in bushings 150 and 152, while steering shaft 110 is rotatably supported in bushings 154 and 156. One end of the upper shift lever 86 is secured to the top of the shift shaft 88 by means of a lock nut 158 which screws onto a threaded end of the shift shaft; one end of the upper steering lever 108 is secured to the top of the steering shaft 110 by means of a lock nut 160 which screws onto a threaded end of the steering shaft. (Only a portion of each of the upper levers is shown in FIG. 5.) The upper levers bear on the flanges of the upper bushings during rotation of the lever and shaft assemblies.

As seen in FIG. 2A, the upper shift lever 86 has a pair of opposing fingers which are pinched together by a screw 172. The resulting compressive force clamps the upper shift lever to the shift shaft. The upper steering lever 108 has a similar construction, with fingers pinched together by a screw 174 to clamp the upper steering lever to the steering shaft. Alternatively, the shift and steering levers can be stampings retained by washers and nuts, with the "pinch" fingers being eliminated. The reference numeral 176 in FIG. 5 designates a pair of seals installed in annular recesses formed at the bottom of the respective lower vertical tubular structures 130 and 132, in surrounding relationship with the shift and steering shafts respectively.

Still referring to FIG. 5, a lower shift lever 90 is welded to the bottom of the shift shaft 88, while a lower steering lever 112 is welded to the bottom of the steering shaft 110. A lower washer 178 is installed between the lower shift lever 90 and the lower vertical tubular structure 130 of the shift and steering control housing 42, while a lower washer 180 is installed between the lower steering lever 112 and the lower vertical tubular structure 132 of housing 42. The washers 178 and 180 provide a bearing surface. During assembly, the bottoms of the shafts are supported by a boss 198 (seen in FIG. 5).

The full length of the lower steering lever 112 is shown in FIG. 5, while only a portion of the lower shift lever 90 is depicted. FIG. 5 shows a clevis 182 and a shoulder screw 184 for attaching the distal end of the lower steering lever 112 to the forward end of the steering rod (not shown in FIG. 5). Similarly, the distal end of the lower shift lever is attached to the forward end of the shift rod by means of a clevis and shoulder screw coupling (not shown in FIG. 5).

Referring to FIG. 2A, the distal end of the upper shift lever 86 is attached to the shift cable assembly 82 by means of a clevis 186 and a clevis pin 188. These components are located inside the hull of the boat (see FIG. 1A). Displacement of the end of the shift cable assembly causes the shift lever and shaft assembly to rotate. Likewise the distal end of the upper steering lever 108 is attached to the steering cable assembly 78 by means of a clevis 190 and a clevis pin 192, and displacement of the end of the steering cable assembly causes the steering lever and shaft assembly to rotate. As best seen in FIG. IA, the shift cable assembly 82 is supported by a bracket 194 and the steering cable assembly 78 is supported by a bracket 196, both brackets being integrally connected to and extending vertically upward from the top mounting plate 20. In response to operation of the steering cable assembly 78, the steering nozzle can be selectively turned left or right to steer the boat as desired during water jet operation. In response to operation of the shift cable assembly 82, the reverse gate can be selectively raised or lowered to propel the boat forward or rearward as desired during water jet operation.

In accordance with the preferred embodiments of the invention, the reverse gate is pivotably mounted to the exit nozzle, and is pivotable between first and second shift positions. The reverse gate in the first shift position is removed from the path of water exiting the exit nozzle and in the second shift position is disposed in the path of water exiting the exit nozzle. The basic principle of reverse gate design is that if a planar surface (flat or contoured) is positioned aft of the pump discharge, the resulting diffusion is a 360-degree fan-out pattern. Contouring the planar surface will (to varying degrees) alter the fan-out pattern, but in general the more the discharge is managed, the more it is restricted. Greater restriction will cause the impeller to stall at lower rpm. Also, as greater amounts of reverse discharge are drawn into the pump inlet, the impeller is more likely to stall at lower rpm due to entrained air. In addition, the deflector surfaces must be defined by a radius or radii that originate at the pivot pin centerline. That pivot centerline must be positioned on the vertical centerline of the exit nozzle. Using these geometric characteristics will balance opening and closing loads. The force required to open or close the gate can be supplemented by addition of features applied to the deflector surface.

One preferred embodiment of the reverse gate is shown in FIGS. 7–9 with the mechanisms for coupling to the shift rod not shown. This concept utilizes two compound curved planes, one attached behind the other, with an aperture in the center of the forward plane. The gate pivots down behind the steering nozzle. The forward plane is for reverse thrust. The inner surface radius is laid out from the pivot pin centerline, as is the aft curved plane. The top edge of both planes are closed to knock down spray. The bottom of the forward plane is as open as possible. The forward plane lower edge defines the discharge angle of the reverse thrust. This reverse thrust is directed forward as much as possible, but must discharge below the ride plate and transom. The aperture in the forward plane allows a metered amount of nozzle discharge into the aft chamber where it is deflected laterally by the aft plane for steering thrust. As with all designs disclosed herein, the steering thrust is deflected opposite of the steered direction. Casting this concept would be limited to sand cast or permanent mold, with one core. The machining is limited to the pivots, control attachment, and travel stops.

More specifically, the reverse gate shown in FIGS. 7–9 comprises a first arm 200 and a second arm 202, both pivotably mounted to the exit nozzle; an inner concave deflecting shield 204 supported by arms 200 and 202, and having a central opening 206; an outer concave deflecting shield 208 arranged axially downstream of the inner concave deflecting shield 204 in opposition to opening 206; and an upper support member 210 and a lower support member 212 for connecting the inner concave deflecting shield 204 to the outer concave deflecting shield 208. The inner concave deflecting shield 204 has a curved concave surface 214 which is penetrated by the opening 206. Preferably the contour of the curved concave surface 214 is a section of a sphere with a first radius of curvature centered at a point lying in the water jet midplane, which point of origin also preferably lies along the axis of the steering nozzle when the reverse gate is in the reverse position. Preferably, opening 206 is generally rectangular (indicated by the dashed rectangle with rounded corners shown in FIG. 9) with its longer dimension extending generally vertically, i.e., parallel to the water jet midplane (indicated by the dashed line designated MP in FIGS. 7 and 9). However, other shapes can be used. The outer concave deflecting shield 208 has a curved concave surface 216. Preferably the contour of the curved concave surface 216 is a section of a sphere with a second radius of curvature also centered at a point lying in the water jet midplane MP, and the radius of curvature of the outer deflecting shield 208 is greater than the radius of curvature of the inner deflecting shield 204. Both deflecting shields are bisected by the midplane and are symmetrical relative thereto. Preferably the upper support member 210 comprises a curved wall which blocks upward flow of water which has passed through the opening 206 and been deflected upward by outer deflecting shield 208, while the lower support member 212 comprises a curved wall which blocks downward flow of water which has passed through opening 206 and been deflected downward by said outer deflecting shield 208. The outer deflecting shield 208 has a circular outer perimeter, while the inner deflecting shield 204 has an oblong profile of length greater than the radius of the outer perimeter of the outer deflecting shield 208, as best seen in FIG. 9. The inner and outer deflecting shields 204 and 208, and the upper and lower support members 210 and 212 define a left-side opening 218 (best seen in FIG. 8) for the escape of "rightturn" water flow to the left of the midplane MP to cause the rearward-moving boat to steer or turn rightward. The "right-turn" water flow comprises a stream of water which exits the steering nozzle when the steering nozzle is directed to the right side of the midplane, is deflected leftward by the inner deflecting shield 204 toward the opening 206, passes through the opening 206 with a leftward flow component and then is deflected leftward to the left-side opening 218 by the outer deflecting shield 208. As it exits the left-side opening 218, the deflected water flow creates a rightward thrust which turns the boat stern to the right in reverse. Conversely, "left-turn" water flow comprises a stream of water which exits the steering nozzle when the steering nozzle is directed to the left side of the midplane, is deflected rightward by the inner deflecting shield 204 toward the opening 206, passes through the opening 206 with a rightward flow component and then is deflected rightward to a right-side opening (opposite to the left-side opening 218) by the outer deflecting shield 208. As it exits the right-side opening, the deflected water flow creates a leftward thrust.

Figure 13:
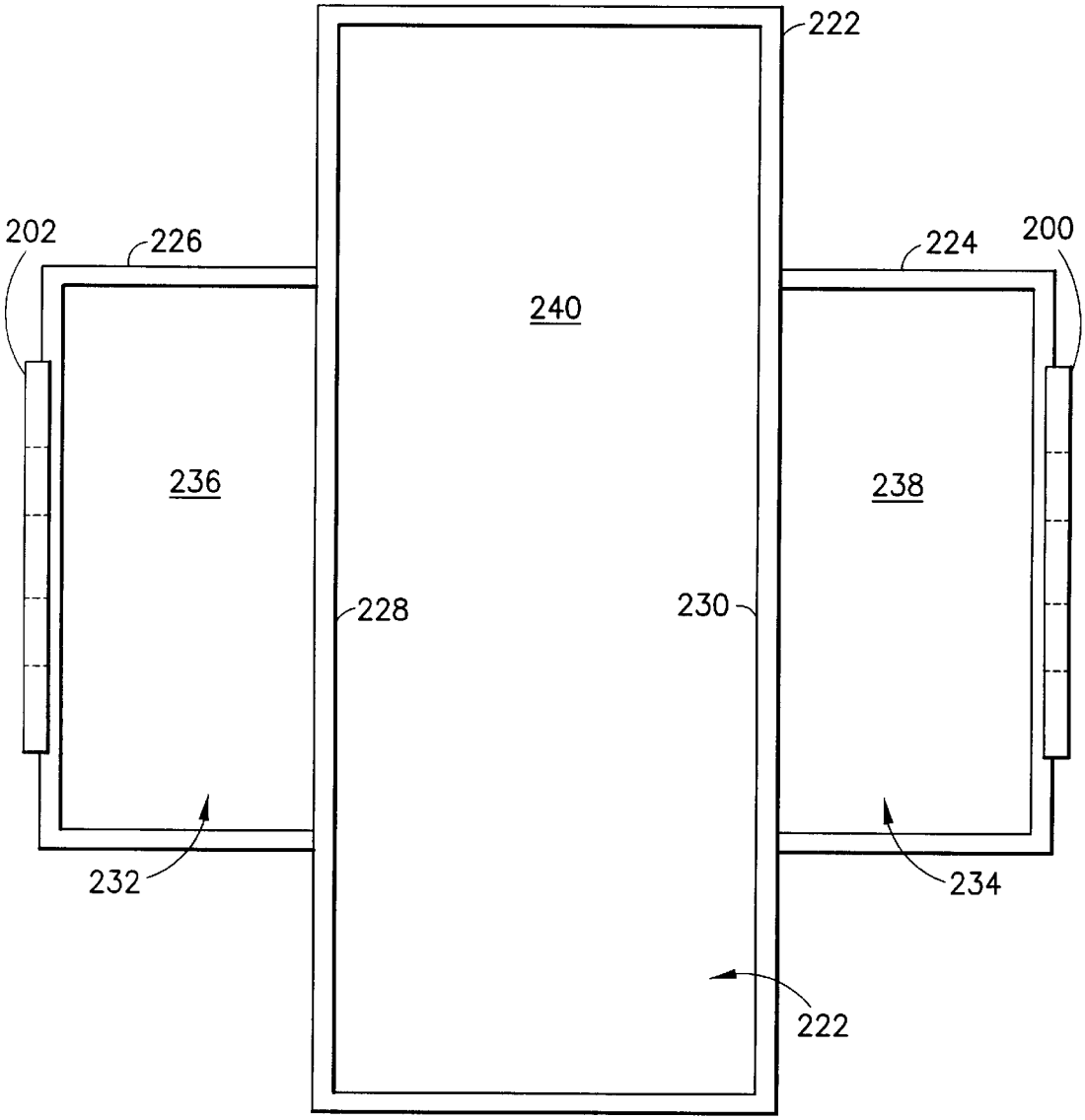

A reverse gate in accordance with another preferred embodiment is shown in FIGS. 10–13. This reverse gate comprises a first arm 200 and a second arm 202, both pivotably mounted to the exit nozzle; and an assembly of channels attached to the distal ends of arms 200 and 202. In accordance with this particular embodiment, the assembly of channels comprises a central reverse thrust channel 222 flanked by a pair of side thrust channels 224 and 226. The reverse thrust channel 222 and side thrust channel 224 share a common divider wall 228, while the reverse thrust channel 222 and side thrust channel 226 share a common divider wall 230. Preferably, the reverse thrust channel 222 has an inner surface defined by a radius originating at the pivot pin centerline. Referring to FIG. 13, the side thrust channel 224 has an inlet 232 and an outlet 234, while side thrust channel 226 has an inlet 236 and an outlet 238. The reverse thrust channel 222 has a single opening 240 extending the full height of the channel.

Figure 10:
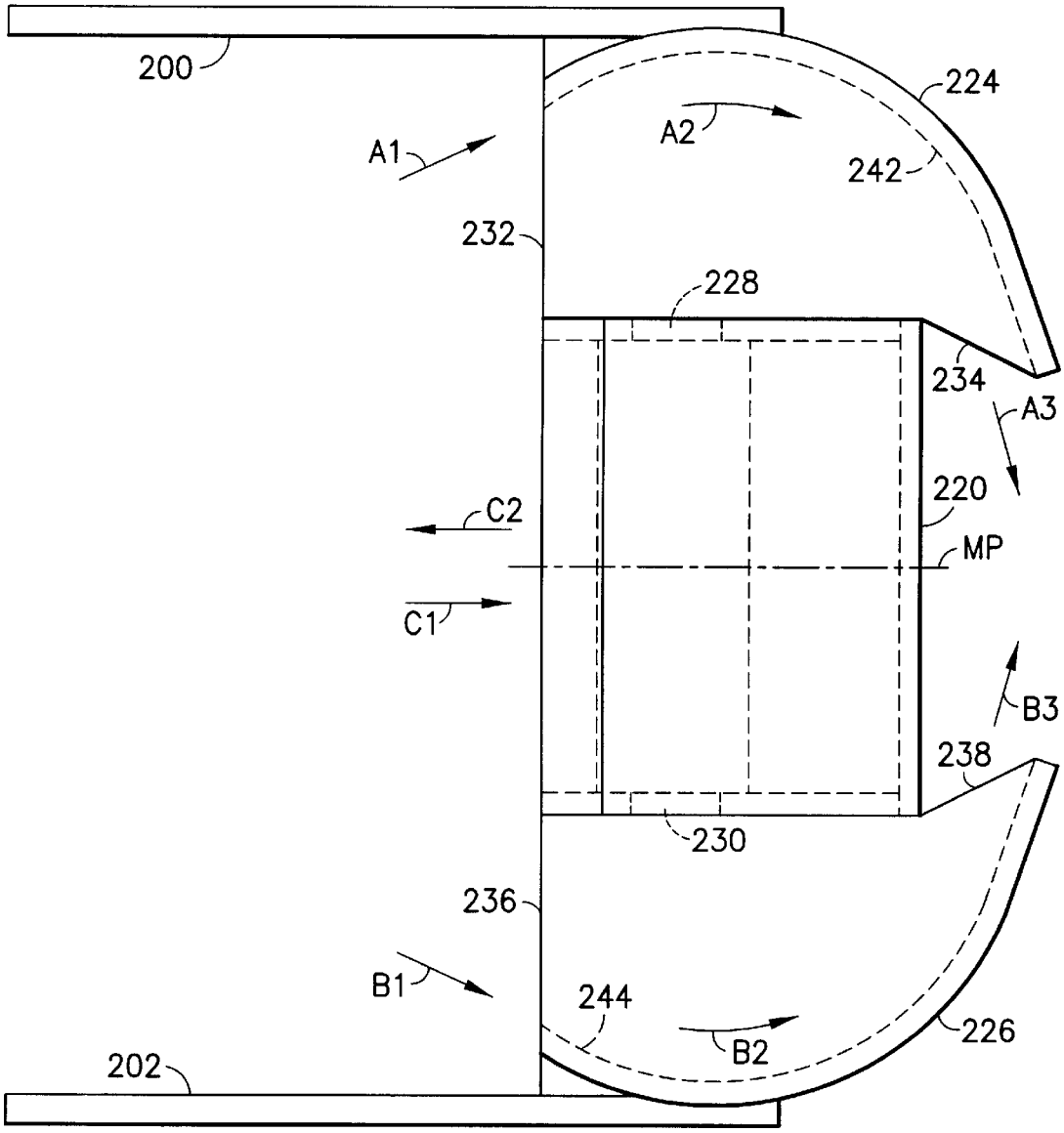

Referring to FIG. 10, an attempt has been made to show the predominant flow path for water exiting the steering nozzle (not shown) for three different angular positions of the steering nozzle. When the steering nozzle is directed to the extreme rightmost position, the water flow exiting the steering nozzle is directed (as indicated by arrow A1) toward the inlet 232 of the side thrust channel 224. As indicated by the angle of arrow A1, the flow exiting the steering nozzle in the extreme rightmost position has rearward and rightward flow components. Inside the side thrust channel 224, the water follows a flowpath (indicated by arrow A2) which conforms to the curvature of the interior surface 242. As a result, the direction of flow gradually changes. At the outlet 234, the water flow exiting the side thrust channel 224 has rearward and leftward components (as indicated by arrow A3). Thus, the side thrust channel 224 effectively reverses the rightward flow component to become a leftward flow component which produces a rightward thrust when the steering nozzle is steered to the right and the reverse gate is down.

Similarly, when the steering nozzle is directed to the extreme leftmost position, the water flow exiting the steering nozzle is directed (as indicated by arrow B1) toward the inlet 236 of the side thrust channel 226. As indicated by the angle of arrow B1, the flow exiting the steering nozzle in the extreme leftmost position has rearward and leftward flow components. Inside the side thrust channel 226, the water follows a flowpath (indicated by arrow B2) which conforms to the curvature of the interior surface 244. As a result, the direction of flow gradually changes. At the outlet 238, the water flow exiting the side thrust channel 226 has rearward and rightward components (as indicated by arrow B3). Thus, the side thrust channel 226 effectively reverses the leftward flow component to become a rightward flow component which produces a leftward thrust when the steering nozzle is steered to the left and the reverse gate is down.

Figure 11:
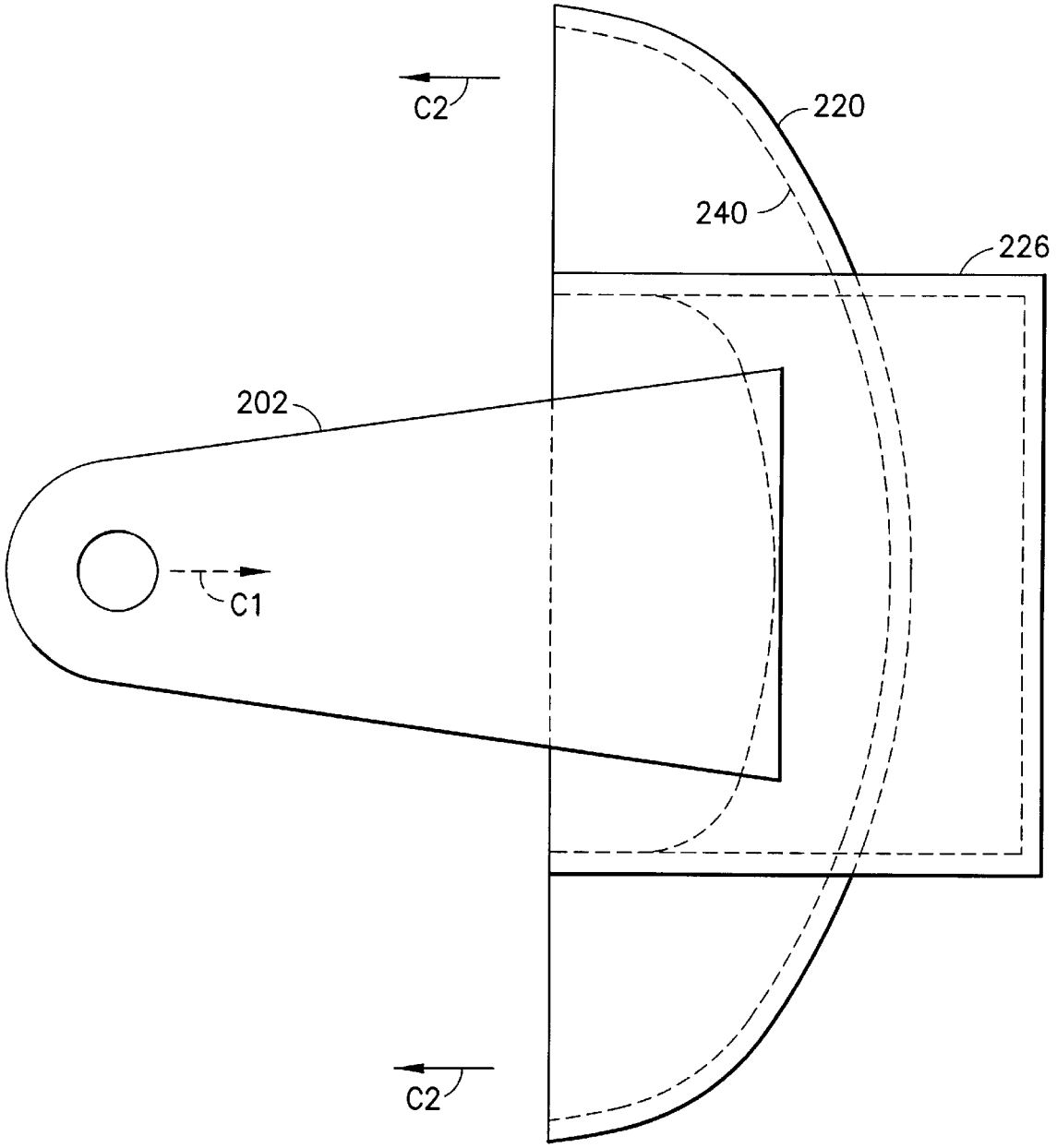
Figure 12:
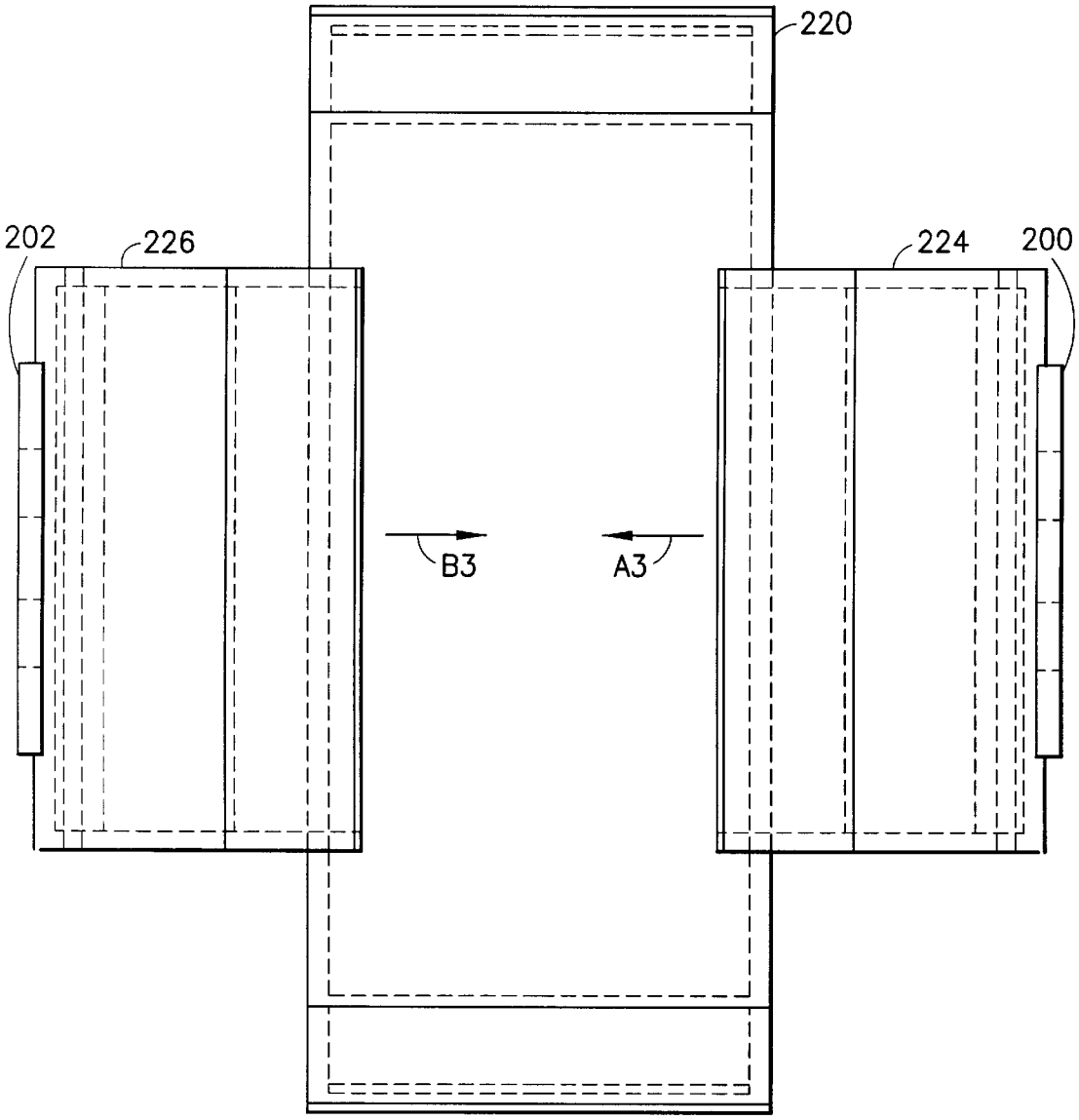

In all positions of the steering nozzle, at least some of the water exiting the steering nozzle flows into the central reversing channel 220, as indicated by dashed arrow C1 in FIG. 11. As best seen in FIG. 13, the reversing channel 220 has an opening 222. The curvature of the interior surface 240 of the reversing channel is best seen in FIG. 11. When the water flowing into the reversing channel impinges on the curved interior surface 240, the flow diverges into generally upward and downward components. These generally upward and downward flows follow the curvature of the interior surface 240. As a result, the respective directions of these flows gradually change. At the opening 240, the upper and lower water flows exit the reversing channel 220 in a forward direction (as indicated by arrows C2). Thus, the reversing channel 220 reverses the rearward flow component to become a forward flow component, thereby producing a rearward thrust when the reverse gate is down.

Another preferred embodiment of the reverse gate is shown in FIGS. 14–16 with the mechanisms for coupling to the shift rod to a boss 260 (see FIG. 16) not shown. The reverse steering thrust in this concept is augmented by the steering nozzle design. The steering nozzle 72 closes to the exit nozzle 70 on the side that it is turned to, and opens a void 262 on the side that it turns away from. When the pump discharge is restricted by the reverse gate 250, pressure is relieved through the nozzle void in the direction desired for reverse thrust and steering. The reverse gate 250 comprises an elliptical cylindrical deflecting shield 256 positioned laterally behind the steering nozzle 72 and supported a pair of arms 254 pivotably mounted to the distal ends of a pair of supports arms 252 affixed to the exit nozzle 70. The deflecting shield 256 is closed on the aft end with a concave arced plane. The arced plane inner radius is laid out from the centerline of the pivot pins 94. The top of the gate is to be as closed as possible to knock down spray, and divert the majority of discharge down and forward. Too much closure at the top center of the arced plane will cause a self-opening force at high rpm. The bottom of the gate is as open as possible. The arced plane lower edge defines the discharge angle of the reverse thrust. This reverse thrust is directed forward as much as possible, but must discharge below the ride plate and transom. The reverse discharge is split by the steering nozzle lower pivot support boss 258. This keeps the reverse thrust from being drawn into the pump inlet when steering straight. The boss 258 also acts like a guide vane to direct the reverse thrust to the side opposite of the steered direction. An alternative to the nozzle "flow splitter" would be a diamond-shaped vane on the bottom of the arced plane. The sides of the elliptical cylinder wrap around the bottom of the gate to define the reverse steering discharge angle. While it is desired that the steering discharge cross under the steering nozzle opposite of the steered angle, in all likelihood it will discharge somewhat forward, and will augment the reverse thrust. This reverse gate can be cast in simple open and closed tooling, and the machining is limited to the pivots, control attachment, and travel stops.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "housing" comprises one or more attached parts. For example, in the disclosed preferred embodiment, the inlet housing, stator housing and exit nozzle form a "housing". However, the present invention encompasses forming the inlet housing and stator housing as one piece, forming the stator housing and the exit nozzle as one piece, forming the inlet housing as two pieces, forming the stator housing as two pieces, and so forth. All such variations fall within the meaning of "housing" as that term is used in the claims. In addition, as used in the claims, the term "predominantly" used to describe water flow in a particular direction means that the reaction force produced by the flow in that particular direction is greater than the counteracting reaction force produced by the flow in the opposite direction, thereby giving rise to a thrust (i.e., net reaction force) in that opposite direction.

What is claimed is:

1. A water jet apparatus comprising:

a housing comprising a water tunnel having an inlet and an outlet;

a steering nozzle pivotably mounted to said housing and having an inlet and an outlet, said steering nozzle being pivotable between first and second steering positions, and said steering nozzle inlet being in flow communication with said housing outlet; and reverse gate being pivotable between first and second shift positions, said reverse gate in said first shift position being removed from the path of water exiting said steering nozzle outlet and in said second shift position being in the path of water exiting said steering nozzle outlet, wherein said steering nozzle in said first steering position directs water flow exiting said housing outlet in a leftward direction and in said second steering position directs water flow exiting said housing outlet in a rightward direction, and said reverse gate comprises a plurality of surfaces for deflecting flow exiting said steering nozzle to produce a thrust capable of propelling a floating craft rearward and leftward when said steering nozzle is in said first steering position and said reverse gate is in said second shift position, and deflecting flow exiting said steering nozzle to produce a thrust capable of propelling a floating craft rearward and rightward when said steering nozzle is in said second steering position and said reverse gate is in said second shift position; and wherein said reverse gate comprises first and second arms pivotably mounted to said housing, a first concave deflecting shield supported by said first and second arms and having an opening, a second concave deflecting shield arranged axially downstream of said first concave deflecting shield and in opposition to said opening in said first concave deflecting shield, and support structure for connecting said first concave deflecting shield to said second concave deflecting shield, said plurality of surfaces comprising an interior surface of said first deflecting shield penetrated by said opening and an interior surface of said second deflecting shield.

2. The water jet apparatus as recited in claim 1, wherein said opening in said first concave deflecting shield is generally rectangular.

3. The water jet apparatus as recited in claim 1, wherein said support structure comprises a first wall which blocks upward flow of water which has passed through said opening and been deflected upward by said second concave deflecting shield, and a second wall which blocks downward flow of water which has passed through said opening and been deflected downward by said second concave deflecting shield.

4. The water jet apparatus as recited in claim 1, wherein said second deflecting shield is a section of a sphere having a center point generally disposed along an axis of said housing and a circular outer perimeter.

5. The water jet apparatus as recited in claim 1, wherein said first deflecting shield has a width greater than its height, said first deflecting shield being disposed so that a first portion of said interior surface of said first deflecting shield opposes said steering nozzle outlet when said steering nozzle is in said first steering position and said reverse gate is in said second shift position, and a second portion of said interior surface of said first deflecting shield opposes said steering nozzle outlet when said steering nozzle is in said second steering position and said reverse gate is in said second shift position, said first and second portions of said interior surface of said first deflecting shield being disposed on opposing sides of said opening.

6. A water jet apparatus comprising:

a housing comprising a water tunnel having an inlet and an outlet;

a steering nozzle pivotably mounted to said housing and having an inlet and an outlet, said steering nozzle being pivotable between first and second steering positions, and said steering nozzle inlet being in flow communication with said housing outlet; and a reverse gate pivotably mounted to said housing, said reverse gate being pivotable between first and second shift positions, said reverse gate in said first shift position being removed from the path of water exiting said steering nozzle outlet and in said second shift position being in the path of water exiting said steering nozzle outlet, wherein said steering nozzle in said first steering position directs water flow exiting said housing outlet in a leftward direction and in said second steering position directs water flow exiting said housing outlet in a rightward direction, and said reverse gate comprises a plurality of surfaces for deflecting flow exiting said steering nozzle to produce a thrust capable of propelling a floating craft rearward and leftward when said steering nozzle is in said first steering position and said reverse gate is in said second shift position, and deflecting flow exiting said steering nozzle to produce a thrust capable of propelling a floating craft rearward and rightward when said steering nozzle is in said second steering position and said reverse gate is in said second shift position; and wherein said reverse gate comprises first and second arms pivotably mounted to said housing, and a deflecting shield supported by said first and second arms, said deflecting shield comprising first through third flow channels, said plurality of surfaces comprising first through third interior surfaces of said deflecting shield which respectively partly define said first through third flow channels, wherein said first interior surface curves along a first arc lying in a first plane, and said second and third interior concave surfaces respectively curve along second and third arcs lying in a second plane generally perpendicular to said first plane.

7. The water jet apparatus as recited in claim 6, wherein said first and second flow channels are defined in part by a first common dividing wall, and said first and third flow channels are defined in part by a second common dividing wall.

8. The water jet apparatus as recited in claim 7, wherein said first and second common dividing walls are generally mutually parallel.

9. The water jet apparatus as recited in claim 6, wherein each of said second and third flow channels has an outlet located aft of said first flow channel.

10. The water jet apparatus as recited in claim 9, wherein said outlets of said second and third flow channels face each other.

11. A water jet apparatus comprising:

a housing comprising a water tunnel having an inlet and an outlet;

a steering nozzle pivotably mounted to said housing and having an inlet and an outlet, said steering nozzle being pivotable between first and second steering positions, and said steering nozzle inlet being in flow communication with said housing outlet; and a reverse gate pivotably mounted to said housing, said reverse gate being pivotable between first and second shift positions, said reverse gate in said first shift position being removed from the path of water exiting said steering nozzle outlet and in said second shift position being in the path of water exiting said steering nozzle outlet, wherein said steering nozzle in said first steering position directs water flow exiting said housing outlet to one side of a midplane of said housing and in said second steering position directs water flow exiting said housing outlet to the opposite side of said midplane, and said reverse gate comprises a plurality of curved concave surfaces for predominantly deflecting flow exiting said steering nozzle to said opposite side of said midplane when said steering nozzle is in said first steering position and said reverse gate is in said second shift position, and deflecting flow exiting said steering nozzle to said one side of said midplane when said steering nozzle is in said second steering position and said reverse gate is in said second shift position, wherein said Plurality of curved concave surfaces do not form one continuous surface.

12. A water jet apparatus comprising:

a housing comprising a water tunnel having an inlet and an outlet;

a reverse gate pivotably mounted to said housing, said reverse gate being pivotable between first and second shift positions, said reverse gate in said first shift position being removed from the path of water exiting said housing outlet and in said second shift position being in the path of water exiting said housing outlet, said reverse gate comprising first and second arms pivotably mounted to said housing, a first concave deflecting shield supported by said first and second arms and having an opening, a second concave deflecting shield arranged axially downstream of said first concave deflecting shield and in opposition to said opening in said first concave deflecting shield, and support structure for connecting said first concave deflecting shield to said second concave deflecting shield.

13. The water jet apparatus as recited in claim 12, wherein said reverse gate comprises first and second arms pivotably mounted to said housing, a first concave deflecting shield supported by said first and second arms and having an opening, a second concave deflecting shield arranged axially downstream of said first concave deflecting shield and in opposition to said opening in said first concave deflecting shield, and support structure for connecting said first concave deflecting shield to said second concave deflecting shield, said plurality of deflecting surfaces comprising an interior concave surface of said first deflecting shield penetrated by said opening and an interior concave surface of said second deflecting shield.

14. The water jet apparatus as recited in claim 12, wherein said flow-deflecting surfaces are curved and concave.

15. The water jet apparatus as recited in claim 12, wherein said support structure comprises a first wall which blocks upward flow of water which has passed through said opening and been deflected upward by said second concave deflecting shield, and a second wall which blocks downward flow of water which has passed through said opening and been deflected downward by said second concave deflecting shield.

16. The water jet apparatus as recited in claim 12, wherein said second deflecting shield is a section of a sphere having a center point generally disposed along an axis of said housing and a circular outer perimeter.

17. The water jet apparatus as recited in claim 12, wherein said first deflecting shield has a width greater than its height.

18. A water jet apparatus comprising:

a housing comprising a water tunnel having an inlet and an outlet;

a reverse gate pivotably mounted to said housing, said reverse gate being pivotable between first and second shift positions, said reverse gate in said first shift position being removed from the path of water exiting said housing outlet and in said second shift position being in the path of water exiting said housing outlet, said reverse gate comprising first and second arms pivotably mounted to said housing, and a deflecting shield supported by said first and second arms, said deflecting shield comprising first through third flow channels defined in part by first through third curved concave surfaces respectively, wherein said first curved concave surface curves along a first arc lying in a first plane, and said second and third curved concave surfaces respectively curve along second and third arcs lying in a second plane generally perpendicular to said first plane.

19. The water jet apparatus as recited in claim 18, wherein said first and second flow channels are defined in part by a first common dividing wall, and said first and third flow channels are defined in part by a second common dividing wall.

20. The water jet apparatus as recited in claim 19, wherein said first and second common dividing walls are generally mutually parallel.

21. The water jet apparatus as recited in claim 18, wherein each of said second and third flow channels has an outlet located aft of said first flow channel.

22. The water jet apparatus as recited in claim 21, wherein said outlets of said second and third flow channels face each other.

23. The water jet apparatus as recited in claim 19, further comprising:

a steering nozzle pivotably mounted to said housing and having an inlet and an outlet, said steering nozzle being pivotable between first and second steering positions, and said steering nozzle inlet being in flow communication with said housing outlet, wherein flow exiting said steering nozzle in said first steering position predominantly enters said first and second flow channels, and flow exiting said steering nozzle in said second steering position predominantly enters said first and third flow channels.

24. A water jet apparatus comprising:

a housing comprising a water tunnel having an inlet, an outlet and a midplane;

means for producing a flow of water through said housing which exits said housing outlet in a rearward direction;

a steering nozzle pivotably mounted to said housing and in flow communication with said housing outlet for selectively redirecting the water flow exiting said housing outlet predominantly to the left of said midplane or predominantly to the right of said midplane, while retaining a rearward component; and a reverse gate pivotably mounted to said housing and disposed in the path of the water flow exiting said steering nozzle for reversing said water flow in a reverse mode, said reverse gate redirecting leftward flow out of said steering nozzle predominantly in the rightward and forward directions, and redirecting rightward and rearward flow out of said steering nozzle predominantly in the leftward and forward directions, wherein said reverse gate comprises a first concave deflecting shield having an opening, and a second concave deflecting shield arranged axially downstream of said first concave deflecting shield and in opposition to said opening in said first concave deflecting shield.

25. A water jet apparatus comprising:

a housing comprising a water tunnel having an inlet, an outlet and a midplane;

means for producing a flow of water through said housing which exits said housing outlet in a rearward direction;

a steering nozzle pivotably mounted to said housing and in flow communication with said housing outlet for selectively redirecting the water flow exiting said housing outlet predominantly to the left of said midplane or predominantly to the right of said midplane, while retaining a rearward component; and a reverse gate pivotably mounted to said housing and disposed in the path of the water flow exiting said steering nozzle for reversing said water flow in a reverse mode, said reverse gate redirecting leftward flow out of said steering nozzle predominantly in the rightward and forward directions, and redirecting rightward and rearward flow out of said steering nozzle predominantly in the leftward and forward directions, wherein said reverse gate comprises a deflecting shield comprising first through third flow channels respectively partly defined by first through third curved concave surfaces, wherein said first curved concave surface curves along a first arc lying in a first plane, and said second and third curved concave surfaces respectively curve along second and third arcs lying in a second plane generally perpendicular to said first plane.

26. A water jet apparatus comprising:

a housing comprising a water tunnel having an inlet and an outlet; and a reverse gate pivotably mounted to said housing, said reverse gate being pivotable between first and second shift positions, said reverse gate in said first shift position being removed from the path of water exiting said housing outlet and in said second shift position being in the path of water exiting said housing outlet, said reverse gate comprising first and second arms pivotably mounted to said housing, and a deflecting shield supported by said first and second arms, said deflecting shield comprising a reversing channel designed to guide water flow having a rearward flow component to predominantly flow with a forward flow component, a first turning channel designed to guide water flow having a leftward flow component to predominantly flow with a rightward flow component, and a second turning channel for guiding water flow having a rightward flow component to predominantly flow with a leftward flow component, wherein the surfaces of said deflecting shield and said first and second turning channels do not form a continuous surface.

27. The water jet apparatus as recited in claim 26, further comprising a steering nozzle pivotably mounted to said housing and in flow communication with said housing outlet, said steering nozzle having first and second steering positions for selectively redirecting the water flow exiting said housing outlet predominantly to the left of a midplane of said housing and predominantly to the right of said midplane respectively, wherein an outlet of said steering nozzle is directed toward an inlet of said first turning channel when said steering nozzle is in said first steering position and said outlet of said steering nozzle is directed at an inlet of said second turning channel when said steering nozzle is in said second steering position.

28. The water jet apparatus as recited in claim 27, wherein said outlet of said steering nozzle is also directed toward a first portion of an inlet of said reversing channel when said steering nozzle is in said first steering position and toward a second portion of said reversing channel when said steering nozzle is in said second steering position.

* * * * *

UNITED STATES PATENT AND TRADEMARK OFFICE

CERTIFICATE OF CORRECTION

PATENT NO. : 6,224,436 B1
DATED : May 1, 2001
INVENTOR(S) : Paul E. Westhoff et al.

It is certified that error appears in the above-identified patent and that said Letters Patent is hereby corrected as shown below:

Column 12,
Line 12, insert before the word "reverse" -- a reverse gate pivotably mounted to said housing, said --

Signed and Sealed this

Eleventh Day of December, 2001

*Attest:*

Nicholas P. Godici

*Attesting Officer*

NICHOLAS P. GODICI
*Acting Director of the United States Patent and Trademark Office*